US007189147B2

(12) United States Patent
Igarashi et al.

(10) Patent No.: US 7,189,147 B2
(45) Date of Patent: Mar. 13, 2007

(54) LENS LAYOUT BLOCK DEVICE

(75) Inventors: Takashi Igarashi, Tokyo (JP); Shinichi Yokoyama, Tokyo (JP); Michio Arai, Tokyo (JP); Masahiko Samukawa, Tokyo (JP); Shuichi Sato, Tokyo (JP)

(73) Assignee: Hoya Corporation, Tokyo (JP)

( * ) Notice: Subject to any disclaimer, the term of this patent is extended or adjusted under 35 U.S.C. 154(b) by 612 days.

(21) Appl. No.: 10/203,674

(22) PCT Filed: Feb. 22, 2001

(86) PCT No.: PCT/JP01/01306

§ 371 (c)(1),
(2), (4) Date: Dec. 10, 2002

(87) PCT Pub. No.: WO01/62438

PCT Pub. Date: Aug. 30, 2001

(65) Prior Publication Data

US 2003/0143936 A1 Jul. 31, 2003

(30) Foreign Application Priority Data

Feb. 22, 2000 (JP) ..... 2000-043779
Feb. 22, 2000 (JP) ..... 2000-043789
Jul. 6, 2000 (JP) ..... 2000-205039

(51) Int. Cl.
*B24B 1/00* (2006.01)
*B24B 7/19* (2006.01)
*B24B 7/30* (2006.01)

(52) U.S. Cl. ..... 451/42; 451/28; 451/41; 451/43; 451/364; 451/384; 451/390

(58) Field of Classification Search ..... 451/28, 451/41, 42, 43, 364, 384, 390
See application file for complete search history.

(56) References Cited

U.S. PATENT DOCUMENTS 3,962,833 A 6/1976 Johnson
4,118,898 A 10/1978 Godot
5,505,654 A * 4/1996 Wood et al. ..... 451/6
5,721,644 A * 2/1998 Murray et al. ..... 359/819

FOREIGN PATENT DOCUMENTS

| | | |
|---|---|---|
| JP | 52-140093 | 11/1977 |
| JP | 53-120451 | 10/1978 |
| JP | 58-071056 | 4/1983 |
| JP | 59-007549 | 1/1984 |
| JP | 62-199345 | 9/1987 |
| JP | 62-260113 | 11/1987 |
| JP | 63-278756 | 11/1988 |
| JP | 3-079241 | 4/1991 |
| JP | 05-78438 | 10/1993 |
| JP | 06-24852 | 4/1994 |
| JP | 6-024852 | 4/1994 |
| JP | 6-143116 | 5/1994 |
| JP | 08-229794 | 9/1996 |
| JP | 10-100057 | 4/1998 |
| JP | 11-138405 | 5/1999 |
| JP | 11-216650 | 8/1999 |
| JP | 2000-052214 | 2/2000 |
| JP | 2000-079545 | 3/2000 |

* cited by examiner

*Primary Examiner*—Joseph J. Hail, III
*Assistant Examiner*—Shantese L. McDonald
(74) *Attorney, Agent, or Firm*—Townsend and Townsend and Crew LLP

(57) ABSTRACT

This apparatus includes a unit for adhering an elastic seal to a lens holder, a unit for causing the lens holder, to which the elastic seal is adhered, to hold a lens, a pivotal arm, an arm driving unit for pivoting the pivotal arm, a clamp unit attached to the pivotal arm to be vertically movable to hold the lens holder, and a clamp driving unit for vertically moving the clamp unit. The pivotal arm is pivoted to sequentially adhere the elastic seal to the lens holder and hold the lens by the lens holder.

13 Claims, 18 Drawing Sheets

BEFORE HOLDER HOLDING

HOLDER HOLDING

LENS LAYOUT BLOCK DEVICE

TECHNICAL FIELD

The present invention relates to a lens layout blocker.

BACKGROUND ART

Spectacle lenses (to be also referred to as lenses hereinafter) include different types such as a single-vision lens, a multifocal lens, and a progressive multifocal lens, and their diameters, outer diameters, lens powers, and the like differ from one lens type to another. Hence, a large number of types of lenses must be fabricated.

Conventionally, edging of such lenses is performed in accordance with the following procedure. For example, assume that a single-vision lens is to be edged. When the prescription lens is determined, if it is an ordinary prescription, a corresponding prescription lens is selected from the stock lenses (mass-production products of the regular inventories).

If the prescription lens is a lens not available from the stock lenses (a custom-made article not available from the regular inventories), it is manufactured by the factory in accordance with the order. A stock lens has an upper surface (convex lens surface) and lower surface (concave lens surface) finished with predetermined lens curvatures (curves) on the basis of the optical design to have a predetermined lens power, and is completed until the final step of a surface process such as hardwearing coating or antireflection coating. Regarding a custom-made article, a lens material for it is prepared in advance in the form of a semifinished product (semifinished lens blank). The lens material is subjected to roughing-out, polishing, and the like in accordance with the ordered prescription power, and then to a surface process, so it is used as the prescription lens.

Once a prescription lens is manufactured, it is horizontally stored in a lens storing tray, together with a processing instruction slip, with its concave lens surface facing down, and is conveyed to an edging line. The operator takes out this prescription lens from the tray, places it on the inspection table of a predetermined inspecting unit such as a lens meter to check its lens power, cylinder axis, and the like. A processing center, the mounting angle of a processing jig (lens holder) with respect to the lens, and the like (optical layout) are determined from the lens information, lens frame shape data, and prescription data about a wearer. On the basis of this information, the lens holder is mounted to the processing center of the lens (blocking). The lens holder is mounted on an edger together with the lens. The lens is edged by a grind stone or cutter, thereby processing the lens into a shape conforming to the shape of an eyeglass frame.

Conventionally, an optical layout and blocking for a lens, which are included in the pre-process for edging of the lens, are manually performed by an operator using specialized devices. This process is very inefficient and low in productivity, and hence becomes a serious hindrance to labor savings. In addition, since an operator must handle the lens with great care so as not to soil, damage, and break it, a significant burden is imposed on the operator. Also, when a lens holder with a lens holding surface conforming to the curvature of the prescription lens is to be selected, the operator tends to erroneously select a different type of lens holder easily. When the operator adheres an elastic seal to the lens holder, the urging force varies, and defective adhesion occurs.

For these reasons, demands have recently arisen for the development of an apparatus for single-vision lenses, and progressive multifocal lenses and multifocal lenses (ABS; Auto Blocker for Single Vision Lens, and ABM; Auto Blocker for Multi-focus Lens), which is designed to automatically perform an optical layout for a lens and lens blocking with a lens holder, thereby improving operation efficiency. This apparatus will be referred to as a layout blocker hereinafter.

As the lens holder used for edging of the spectacle lens, for example, one disclosed in, e.g., Japanese Utility Model Laid-Open No. 6-024852 and Japanese Patent Laid-Open No. 9-225798, are known. Such a lens holder is usually formed of a cylindrical body and has a concave spherical lens holding surface at its distal end face. When holding a lens, a thin elastic seal is adhered to the lens holding surface in advance, and is urged against the convex lens surface of the lens so as to be adhered to it. The lens holding surface has a large number of fine projections, each with a triangular section, radially formed on its entire edge, so that the tight bonding properties between the lens surface and elastic seal is increased and rotation of the elastic seal is prevented.

When a lens is mounted on a conventionally known lens holder, it is then mounted on an edging device together with the lens holder. The edge of the lens is edged by a grind stone or cutter, thereby processing the lens into a shape conforming to the shape of an eyeglass frame. When performing edging, the lens holder that holds the lens is mounted on one of two coaxial clamp shafts. The two surfaces of the lens are clamped by the lens holder and the other clamp shaft. The two clamp shafts are rotated in one direction, and are simultaneously controlled, on the basis of the lens frame shape data, to move in a direction perpendicular to the axis. Edging is thus performed with the grind stone or cutter.

The lens types are infinite since one lens power D (diopter) can be combined with convex and concave surface curves, and are actually determined considering the optical aberration and inventory management. More specifically, a lens design in which the number of types of convex surface curves is decreased while different concave surface curves are used is employed. For example, regarding a progressive multifocal lens, up to 8 types of lenses, ranging from a 2-curve lens to 9-curve lens, may be prepared. In the case of a single-vision lens, as it generally copes with a wide range of power, for example, 12 types of lenses, ranging from 0-curve lens to 11-curve lens, are sometimes prepared.

The lens power D (Diopter) is expressed by a difference in curvature between a convex surface curve D1 and a concave surface curve D2. In the semi-finished lenses such as single-vision lenses or progressive multifocal lenses, their lens powers are classified in accordance with only the convex surface curves D1. For example, a single-vision lens with a convex-surface lens power D of 4 is called a 4-curve lens, and its radius of curvature is calculated by $D=(N-1)\times 1000/R$ (mm) where N is the refractive index of the lens, which is 1.50 when the lens material is diethyleneglycol bis allylcarbonate, which is used most generally, and R is the radius of curvature of the convex lens surface. Hence, in the case of a 4-curve lens, when this value is substituted in the above equation, $4=(1.5-1)\times 1000/R$ yields R=125 mm. Similarly, in the case of a 7-curve lens, it is converted into a radius of curvature of about 71 mm. In the case of an 11-curve lens, its radius of curvature is about 45 mm.

Conventionally, as the lens holders, to enable stable holding, specially prepared lens holders are used for individual lenses with different lens powers, respectively, or two types of lens holders, i.e., one for a shallow curve and one for a deep curve, are used. When several types of lens holders having lens holding surfaces with different curvatures are prepared and are to be selectively used in accordance with the curvature of the convex lens surface of the lens to be held, the number of types of holders themselves increases, imposing problems in maintaining and managing them. With the method of using the two types of holders, i.e., one for the shallow curve and one for the deep curve, a flexible material (e.g., plastic) is used as the material of the holders themselves. Plastic, however, has a problem in its durability and precision. All the lens holders need be fabricated with the same size regardless of the curvatures of their lens holding surfaces. Conventionally, the types of the holders are discriminated from identification symbols or numbers formed on the outer surfaces of the lens holders by engraving or the like. In this case, the operator must form the identification symbols or numbers by engraving or the like. This operation is cumbersome. The operator must check the lens holder by manually holding it. Moreover, if the identification symbol or number becomes unclear due to the soil and wear of the surface of the holder itself, defective engraving, or the like, it is difficult for the operator to read it. Therefore, the operator must handle the lens holder carefully. In particular, when this identification method is applied to the layout blocker described above, the operator and sensor must be able to discriminate the type of the lens holder easily and reliably.

In any case, in a layout blocking step before performing conventional lens edging, various types of operation steps must be performed by the operator. These operations must be performed in a limited space, resulting in a very poor operation efficiency.

DISCLOSURE OF INVENTION

It is an object of the present invention to provide a lens layout blocker for solving the conventional problems described above and meeting their demands.

More specifically, it is the main object of the present invention to provide a lens layout blocker which can automatically perform layout and blocking operations for a lens within a limited space.

It is another object of the present invention to provide a lens holder which can perform holding well and can be easily and reliably discriminated as to whether it is of the same type.

It is still another object of the present invention to provide a lens layout blocker which automatically performs layout and blocking operations for a lens in order to edge the lens, so the operability and productivity are improved and labor savings are enabled.

It is still another object of the present invention to provide an urging change unit for a lens layout blocker, which can reliably adhere an elastic seal to a lens holder and adhere a lens to the elastic seal.

In order to achieve the above objects, there is provided an apparatus for attaching a lens to a lens holder, characterized by comprising a unit for adhering an elastic seal to a lens holder, a unit for causing the lens holder, to which the elastic seal is adhered, to hold a lens, a pivotal arm, an arm driving unit for pivoting the pivotal arm, a clamp unit attached to the pivotal arm to be vertically movable to hold the lens holder, and a clamp driving unit for vertically moving the clamp unit, wherein the pivotal arm is pivoted to sequentially adhere the elastic seal to the lens holder and hold the lens by the lens holder.

According to another aspect of the present invention, there is provided a lens layout blocker characterized by comprising a holder supply unit for holding a lens holder at a holder mounting position, conveying the lens holder to a seal adhering position, causing an elastic seal to be adhered to the lens holder at the seal adhering position and conveying the lens holder to a lens holding position, and causing a lens to be held by the elastic seal at the lens holding position, the holder supply unit comprising a pivotal arm, an arm driving unit for pivoting the pivotal arm within a horizontal plane, a clamp unit for holding the lens holder attached to the pivotal arm to be vertically movable, and a clamp driving unit for vertically moving the clamp unit.

According to still another aspect of the present invention, there is provided a lens holder formed of a cylindrical member and having a lens holding surface formed of a concave spherical surface at a distal end thereof to hold a plurality of types of lenses with convex lens surfaces of different curvatures by an elastic seal adhered to the lens holding surface, characterized in that the plurality of types of lenses are classified into a plurality of lens groups in which lenses with convex lens surfaces of similar curvatures form one army, and the lens holder comprises a plurality of types of lens holders corresponding to the lens groups, each of respective types of the lens holders serving to hold a lens belonging to a corresponding lens group with an edge of a lens holding surface thereof.

According to still another aspect of the present invention, there is provided a lens holder formed of a cylindrical member and having a lens holding surface formed of a concave spherical surface at a distal end thereof to hold a plurality of types of lenses with convex lens surfaces of different curvatures by an elastic seal adhered to the lens holding surface, characterized in that the plurality of types of lenses are classified into a plurality of lens groups in which lenses with convex lens surfaces of similar curvatures form one group, and the lens holder comprises a plurality of types of lens holders corresponding to the lens groups, each of respective types of the lens holders having a lens holding surface a lens holding surface with a radius of curvature equal to or smaller than a minimum radius of curvature of a convex lens surface of a lens belonging to a corresponding lens group.

According to still another aspect of the present invention, there is provided a lens layout blocker for urging, at a seal adhering position, a lens holding surface of a lens holder against an elastic seal, thus adhering the elastic seal to the lens holding surface, and urging, at a blocking position, the elastic seal, adhered to the lens holding surface of the holder, against a lens, thus adhering the lens to the elastic seal, characterized by having a unit for urging the elastic seal, adhered to the lens holding surface of the lens holder, against the lens with an urging force smaller than that with which the lens holding surface of the lens holder is urged against the elastic seal.

BEST MODE OF CARRYING OUT THE INVENTION

Figure 1A:
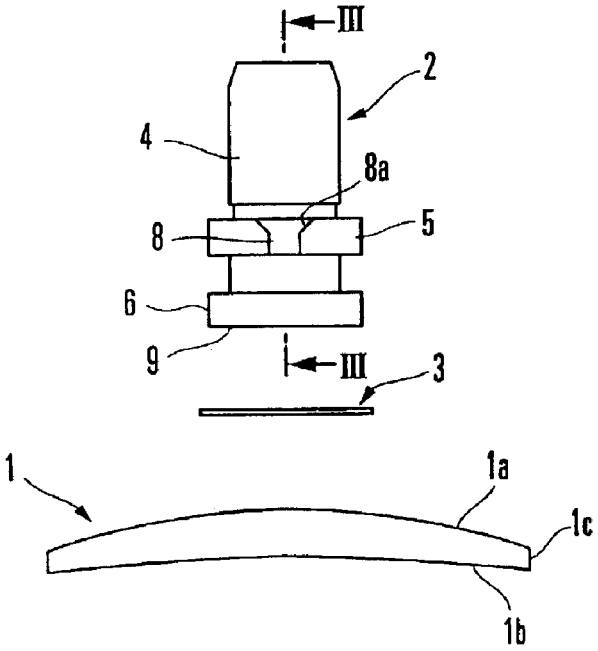
FIGS. 1(*a*) and 1(*b*) are front and rear views, respectively, of a lens holder used in an apparatus for attaching a lens to a lens holder according to the present invention.

An apparatus for attaching a lens to a lens holder according to the present invention will be described in detail by way of embodiments shown in the drawings.

Figure 1B:
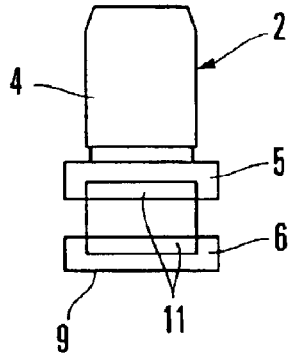
Figure 2:
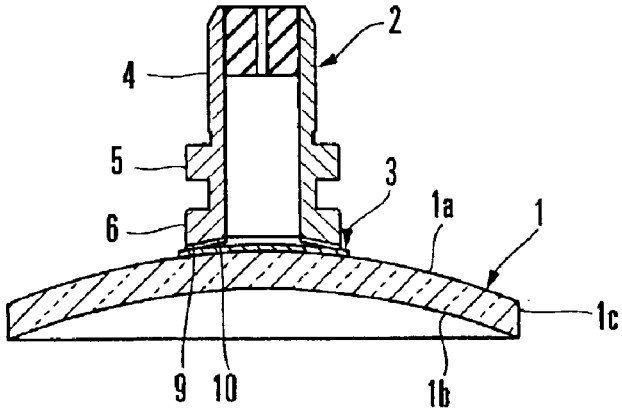
FIG. 2 is a sectional view showing a state in which a lens is mounted on the lens holder through an elastic seal.
Figure 3A:
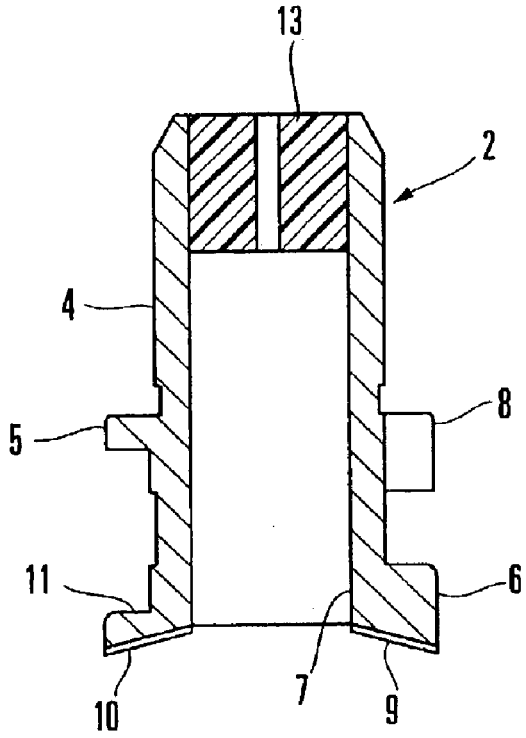
FIGS. 3(*a*), 3(*b*), and 3(*c*) are an enlarged sectional view taken along the line III—III of FIG. 1, a view showing a lens holding surface, and an enlarged sectional view of this lens holding surface, respectively.
Figure 3B:
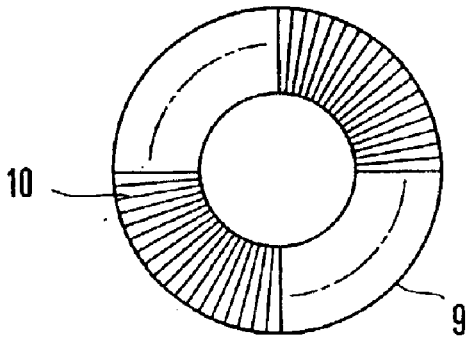
Figure 3C:
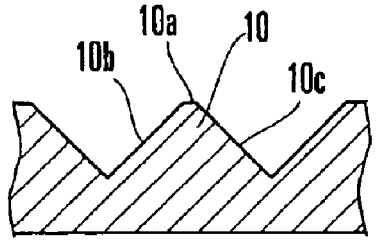

FIGS. 1(*a*) and 1(*b*) are front and rear views, respectively, of a lens holder used in an apparatus for attaching a lens to the lens holder according to the present invention, FIG. 2 is a sectional view showing a state in which a lens is held by the lens holder through an elastic seal, and FIGS. 3(*a*), 3(*b*), and 3(*c*) are an enlarged sectional view taken along the line III—III of FIG. 1, a view showing a lens holding surface, and an enlarged sectional view of this lens holding surface, respectively.

Referring to FIGS. 1(*a*) to 3(*c*), reference numeral 1 denotes a spectacle single-vision lens 1 (to be merely referred to as a lens hereinafter) made of plastic and has a convex lens surface 1*a* and concave lens surface 1*b*. The edge of the lens 1 is edged by an edger to conform to the shape of a lens frame. When the lens 1 is a single-vision lens, as it generally copes with a wide range of power, as described above, it is prepared in 12 types, e.g., from a 0-curve lens to 11-curve lens. To make a lens holder 2 common, lenses 1 are classified into a plurality of lens groups each consisting of lens with similar curves, e.g., a first lens group of 0- to 3-curve lenses, a second lens group of 4- to 6-curve lenses, and a third lens group of 7- to 11-curve lenses. Reference numeral 3 denotes an elastic seal to be adhered to the lens holder 2. The convex lens surface 1*a* of the lens 1 is held by the lens holder 2 through the elastic seal 3.

The lens holder 2 is formed of a metal such as stainless steel into a collared cylindrical member which includes a fitting shaft portion 4, and a flange 5 and lens holding portion 6 integrally formed on the outer surface of the fitting shaft portion 4, closer to the distal end, and at the distal end, respectively. The fitting shaft portion 4 has, for example a length of 35 mm, an outer diameter of about 14 mm, and a central hole 7 with a hole diameter of about 10 mm.

The flange 5 defines the fitting amount of the fitting shaft portion 4 into a clamp shaft (to be described later), and has a thickness of about 5 mm and an outer diameter of about 20 mm. A notched groove 8 is formed in the outer surface of the flange 5 to serve as a rotation preventive portion that prevents rotation of the lens holder 2 with respect to the clamp shaft. A taper surface 8*a* is formed on that opening portion of the notched groove 8 which is opposite to the lens holding portion 6, and is open outward so the fitting shaft portion 4 can be fitted on the clamp shaft easily.

The lens holding portion 6 is formed on the outer surface of the distal end of the fitting shaft portion 4, and has a thickness and outer diameter substantially equal to those of the flange 5. A gap of about 5 mm is formed between the lens holding portion 6 and flange 5. That surface of the lens holding portion 6 which comes into tight contact with the elastic seal 3 forms a concave spherical lens holding surface 9 corresponding to the convex lens surface 1*a* of the lens 1. If the radius of curvature of the lens holding surface 9 is larger than that of the convex lens surface 1*a*, only the central portion of the lens holding surface 9 comes into contact with the convex lens surface 1*a*, while the peripheral portion thereof does not come into contact with it. Then, the lens 1 is held unstably. On the contrary, if the radius of curvature of the lens holding surface 9 is smaller than that of the convex lens surface 1*a*, only the peripheral portion of the lens holding surface 9 comes into contact with the convex lens surface 1*a*, while the central portion thereof does not come into contact with it. Thus, the lens 1 is held stably, and misalignment or the like can be prevented.

According to this embodiment, lens holders 2 with lens holding surfaces 9 of different radii of curvature are prepared for lens groups, respectively. A lens holder 2 used for the first lens group of 0- to 3-curve lenses described above is set as a 4-curve holder. A lens holder 2 used for the second lens group of 4- to 6-curve lenses is set as a 7-curve holder. A lens holder 2 used for the third lens group of 7- to 11-curve lenses is set as a 11-curve holder. More specifically, the lens holders 2 include types corresponding in number (three types) to the lens groups. Each lens holder 2 has a lens holding surface 9 with a radius of curvature smaller than that of the convex lens surface 1*a* of the lens 1 belonging to the corresponding lens group (regarding a lens with 11 curves, a lens holder with the same curves as those of the convex lens surface 1*a* is used), to abut against the convex lens surface 1*a* of the lens 1 at the peripheral portion. In this manner, when the curvature of the lens holding surface 9 of the lens holder 2 is formed such that the curvature of the lens holding surface 9 is larger than that of the convex lens surface 1*a* of the lens 1 for each lens group, the lens 1 can be held mostly at the peripheral edge portion of the lens holding surface 9, as shown in FIG. 2. Note that only the radii of curvature of the lens holding surfaces 9 are different, and except for that the structures of the lens holders 2 are completely the same. If a difference in radius of curvature between the convex lens surface 1*a* and lens holding surface 9 is large, the degree of adhesion between these two surfaces is low. Therefore, the smaller this difference, the more desirable.

A large number of fine projections 10 are radially formed on the entire lens holding surface 9 in order to increase the adhesion bond strength with the elastic seal 3. Each fine projection 10 has an isosceles triangular section. Hence, a wall surface 10*b* in the rotational direction of the lens holder 2 and a wall surface 10*c* opposite to it form slants of the same angle of inclination (e.g., 45°) with respect to a vertex 10*a* of the projection 10 as the boundary. When the slants have the same angle in this manner, the elastic seal 3 comes into tight contact with the two slants evenly. As the contact area increases, the appropriate flexibility and deformability of the seat are utilized, so that the lens holding force can be increased. Since the elastic seal 3 comes into press contact with the two slants of the same angle of inclination evenly, an unbalance rotation force is canceled and is not generated. Therefore, the rotational shift of the elastic seal 3 that decreases the holding precision of the lens does not occur.

A rotation preventive portion 11 is formed on the outer surfaces of the flange 5 and lens holding portion 6 to engage with the engaging portion of a holder storing cassette 31 (to be described later) that stores the lens holder 2. The rotation preventive portion 11 is a groove formed by cutting part of the outer surfaces of the flange 5 and lens holding portion 6 from a direction perpendicular to the axis. The rotation preventive portions 11 and 8 are formed to be phase-shifted from each other by 180° so they are back to back.

A member 13 for discriminating the type of the lens holder 2 is fitted in the lens holder 2 on the proximal end of the fitting shaft portion 4 by press fitting. One end face of the member 13 forms substantially one surface together with the proximal end face of the lens holder 2. The member 13 is formed of a synthetic resin into a cylindrical member colored in a required color. The color of the member is as follows. For example, for a 4-curve holder, the member 13 is colored white. For a 7-curve holder, the member 13 is colored red. For a 11-curve holder, the member 13 is colored blue. Therefore, by seeing the color of the member 13, the operator can discriminate at a glance whether the lens holder 2 is a 4-, 7-, or 11-curve holder.

As the elastic seal 3, one which is formed of thin rubber with a thickness of about 0.5 mm to 0.6 mm into a ring shape with an outer diameter (about 22 mm) larger than that of the lens holding surface 9 and an inner diameter (about 8 mm) smaller than the hole diameter of the lens holder 2, and is coated with an adhesive mass on the two surfaces is used.

Supply of the lens holder, supply of the elastic seal and lens to this holder, and edging of the lens will be briefly described with reference to FIGS. 4 to 10.

Figure 4:
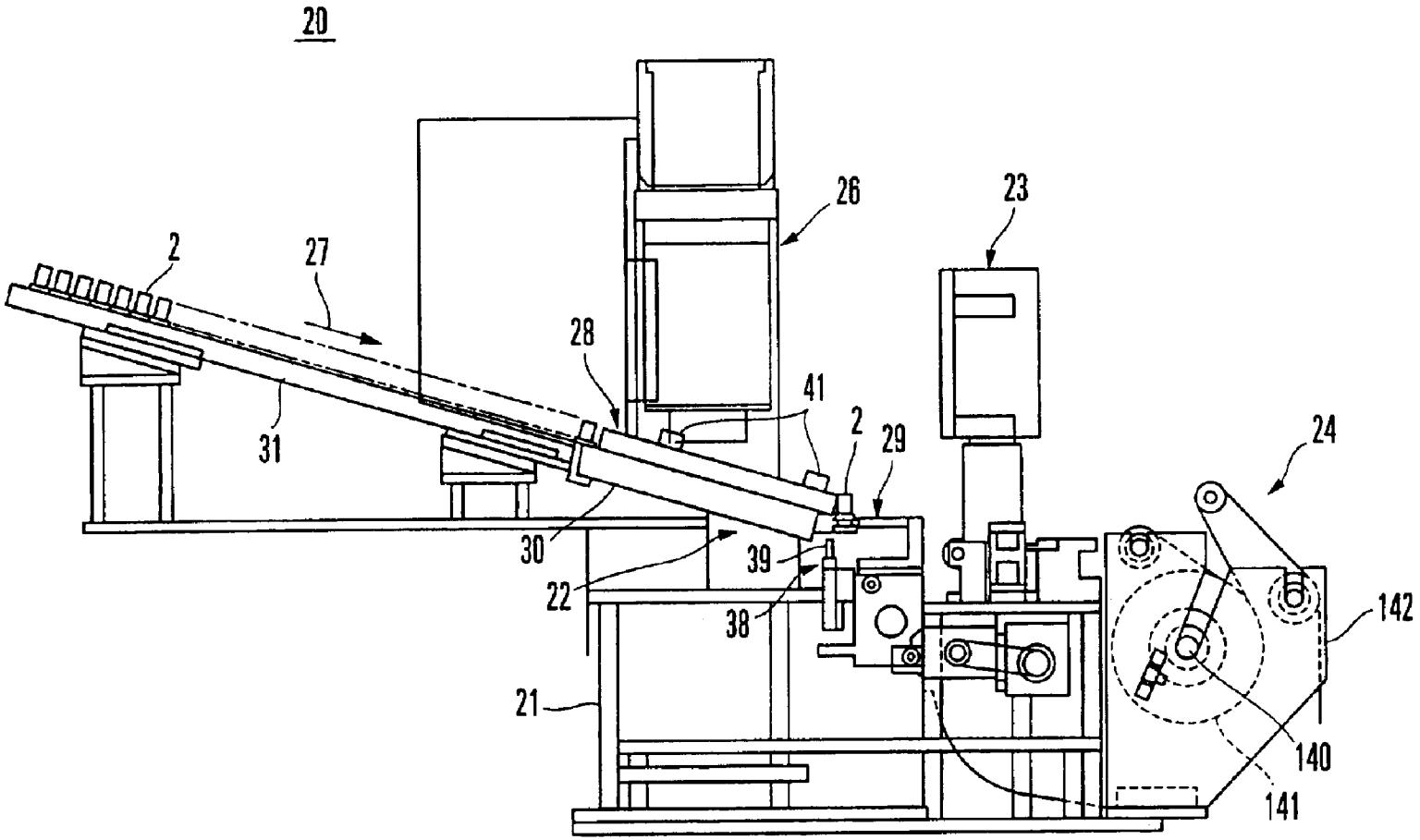
FIG. 4 is a front view of an ABS for a single-vision lens.
Figure 5:
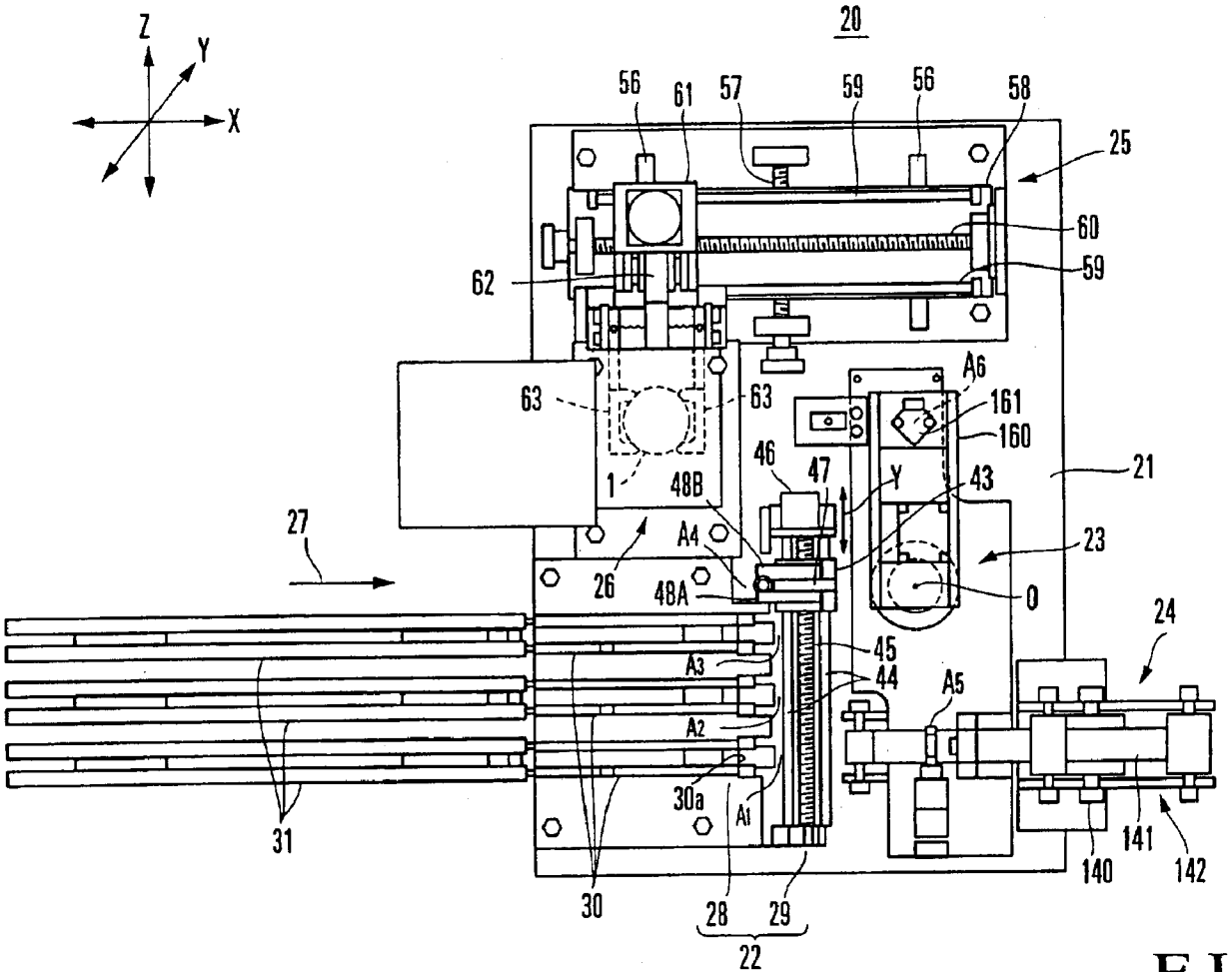
FIG. 5 is a plan view of the ABS in FIG. 4.
Figure 6A:
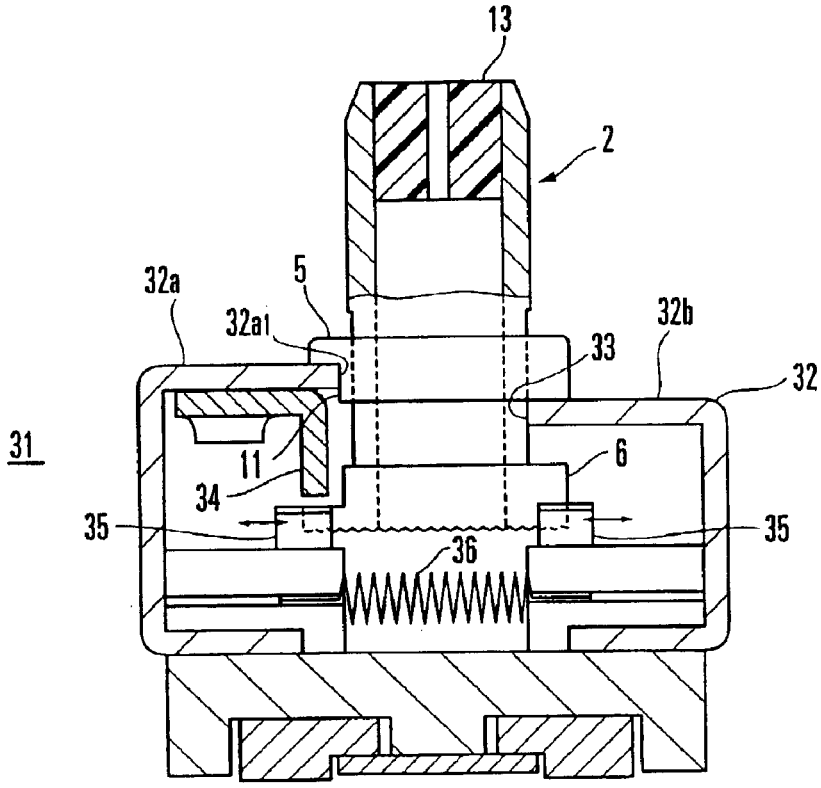
FIGS. 6(*a*), 6(*b*), and 6(*c*) are a sectional view of a holder storing cassette, a view of the same before being mounted on a chute, and a view of the same mounted on the chute, respectively.
Figure 6B:
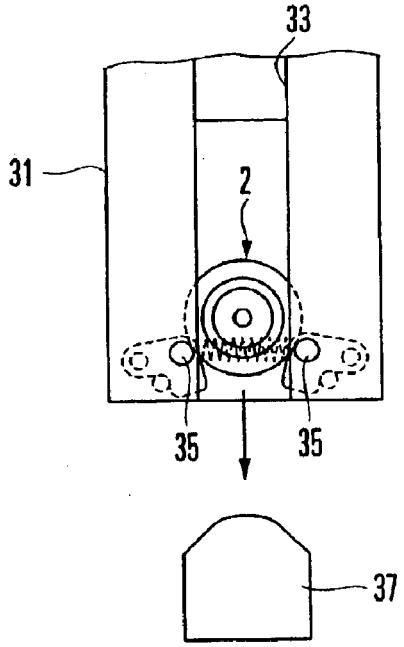
Figure 6C:
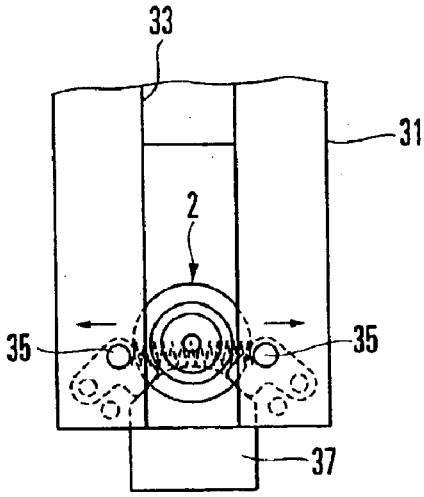
Figure 7:
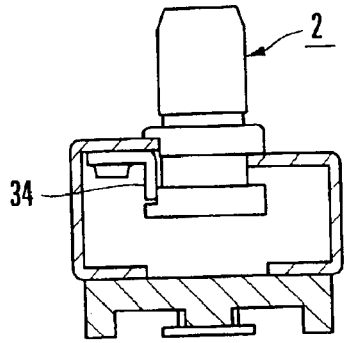
FIG. 7 is a sectional view of the central portion of the cassette away from pin positions.
Figure 8:
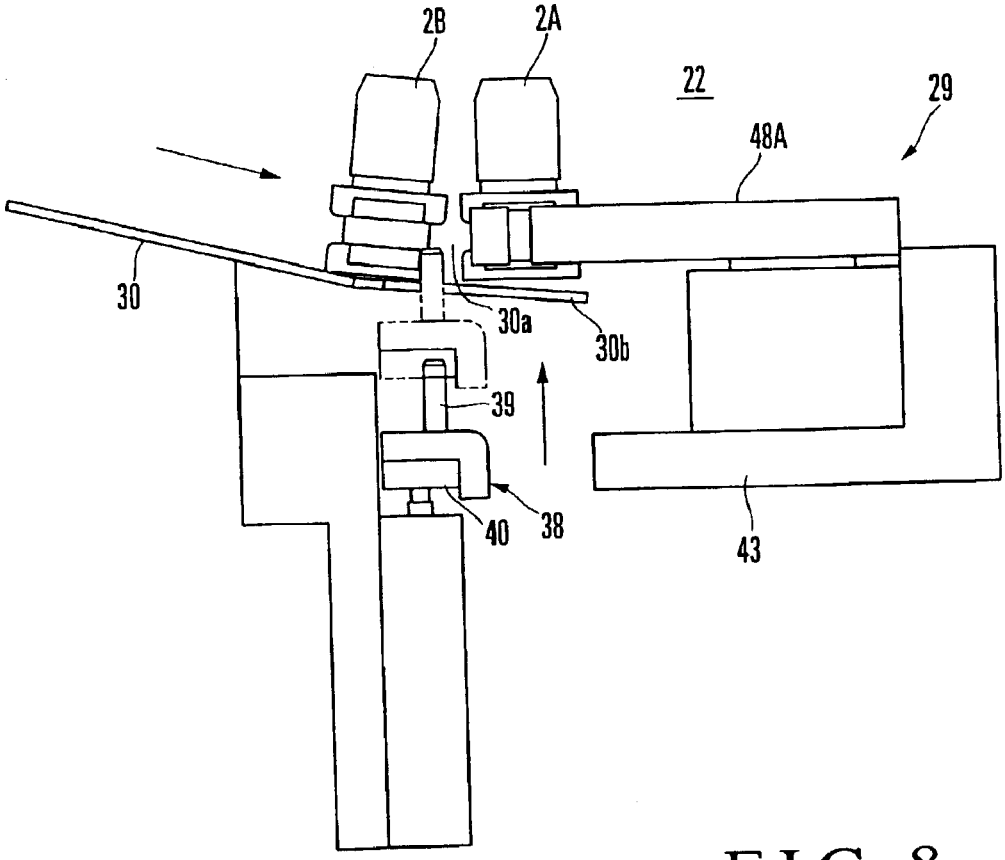
FIG. 8 is a view showing a lens holder transfer portion and a shutter mechanism.
Figure 9:
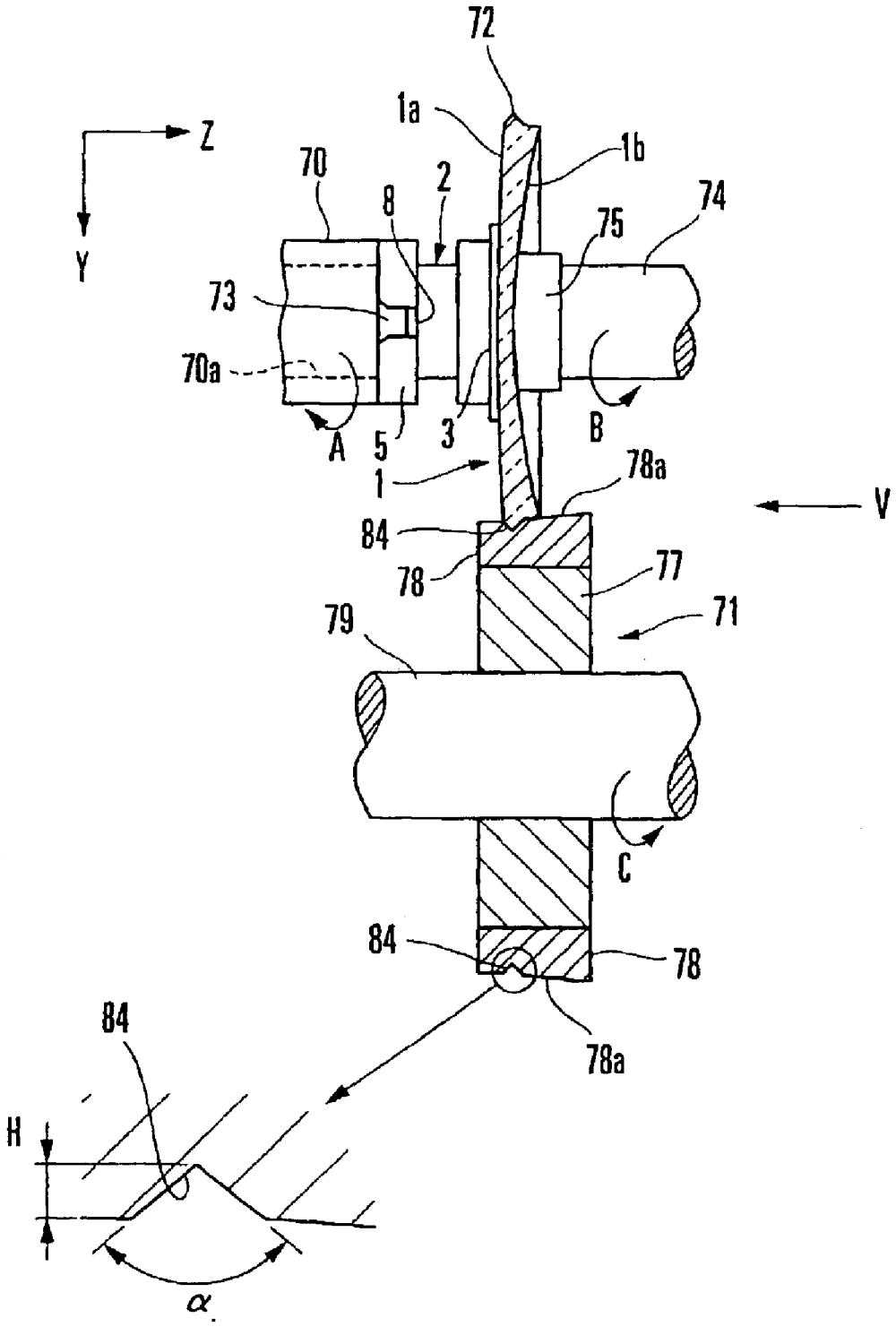
FIG. 9 is a view showing a state in which an arris process for a lens is being performed.
Figure 10:
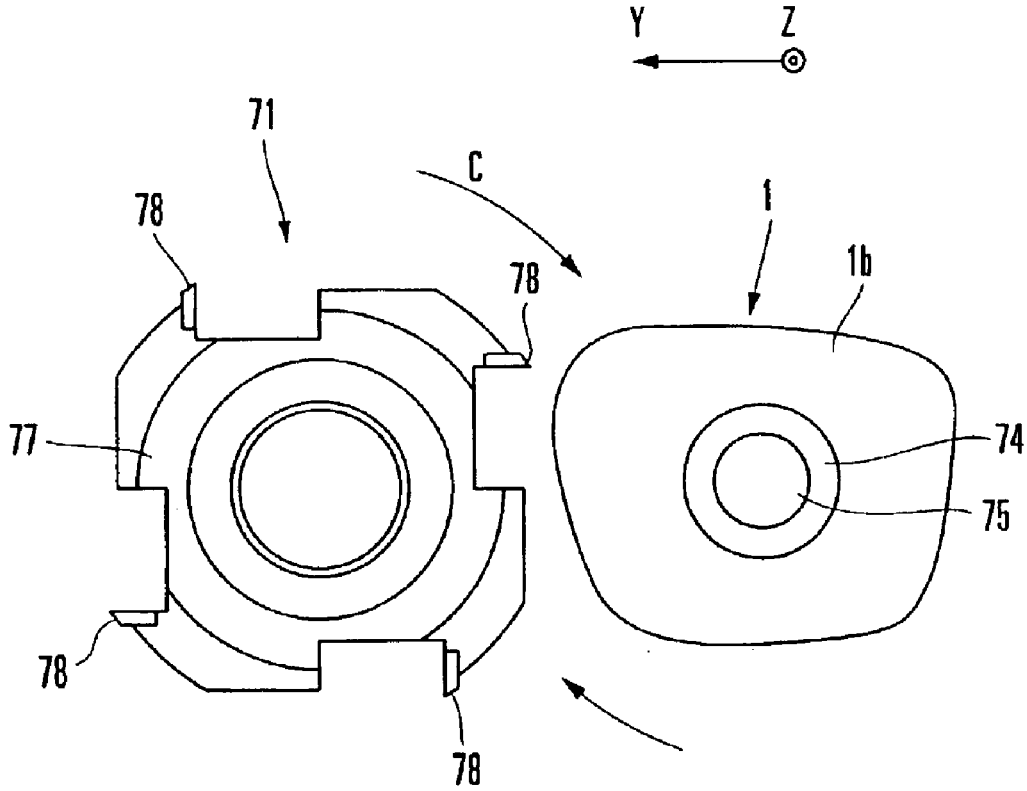
FIG. 10 is a view seen from an arrow V of FIG. 9.

FIG. 4 is a front view of an ABS for a single-vision lens, FIG. 5 is a plan view of the same, FIGS. 6(*a*), 6(*b*), and 6(*c*) are a sectional view of a holder storing cassette, a view of the same before being mounted on a chute, and a view of the same mounted on the chute, respectively, FIG. 7 is a sectional view of the central portion of the cassette away from pin positions, FIG. 8 is a view showing a lens holder transfer portion, FIG. 9 is a view showing a state in which an arris process for a lens is being performed, and FIG. 10 is a view seen from an arrow V of FIG. 9.

Referring to FIGS. 4 to 6, an ABS 20 is set adjacent to the edger (not shown), has a holder conveying unit 22 formed on a base 21, a holder holding unit 23, a seal supply unit 24, a lens supply unit 25, a lens measuring device 26, and the like, and adopts a batch method of sequentially processing 12 types (0- to 11-curve lenses) of single-vision lenses with different convex surface curves in a random manner.

The holder conveying unit 22 serves to supply three types of lens holders 2, 4-, 7-, and 11-curve holders to the holder holding unit 23, and has a holder supply mechanism 28 and holder support mechanism 29.

The holder supply mechanism 28 has three chutes 30 which are inclined at such an angle (e.g., 20°) that the lens holders 2 can slide on them by their own weights in the supply direction (a direction of an arrow 27 of FIG. 5) of the lens holder 2, and are arranged parallel to each other in the widthwise direction. Three holder storing cassettes 31 each storing a necessary number of (e.g., 42) lens holders 2 for each type are detachably set upstream of the chutes 30 at the same angle as that of the chutes 30.

Referring to FIG. 6, each cassette 31 is formed of a metal, a synthetic resin, or the like into a thin, rectangular hollow body with two open ends. Thus, the cassette 31 stores the lens holders 2 that are aligned in a line while the rotation preventive portions 11 are set in one direction. An opening 33 is formed in an upper plate 32 of the cassette 31 throughout the entire length. That portion of the lens holder 2 which is closer to the proximal end than the flange 5 projects upward from the cassette 31 through the opening 33. Therefore, the member 13 can be visually confirmed from above the cassette 31. When different types of lens holders 2 are mixedly stored in the cassette 31, they can be checked at a glance. Also, erroneous mounting of the cassette 31 can be prevented. In other words, since the cassette 31 itself is identified by the color of the member 13, a mistake that a certain cassette is erroneously set on a chute other than a chute where it should be, and a mistake that a certain cassette is set across a plurality of chutes can be prevented.

The width of the opening 33 is set to be slightly larger than the outer diameter of the fitting shaft portion 4 of the lens holder 2. The opening 33 slidably supports the lower surface of the flange 5. The upper plate 32 is formed with different heights such that its one plate portion 32*a* is slightly higher than its other plate portion 32*b* through the opening 33 by almost the thickness of the cassette 31. An end edge 32*a*1 of one plate portion 32*a* is inserted in the rotation preventive portion 11 of the lens holder 2. An inverted L-shaped bracket 34 to be inserted in the rotation preventive portion 11 is fixed to the lower surface of the plate portion 32*a*. This sets the direction of the lens holder 2 and prevents free rotation of the lens holder 2.

In the cassette 31, a pair of removal preventive pins 35 for preventing removal of the lens holder 2 are disposed near the downstream opening so as to be movable to the left-and-right direction. These pins 35 are connected to each other at their lower ends through a tension coil spring 36 and are biased in directions to come close to each other. Thus, the pins 35 are normally in contact with the lens holding portion 6 to prevent the lens holder 2 from being removed. When the cassette 31 is mounted on the chute 30, the pins 35 move in directions to separate from each other against the tension coil spring 36, thereby unlocking the lens holder 2. The pins 35 are moved in the separating directions by an appropriate member 37 provided to the chute 30, as shown in FIG. 6(*c*).

FIG. 7 is a sectional view of the central portion of the cassette separated from the pin positions. This cassette is different from that in FIG. 6 in that it does not have the pair of removal preventive pins 35 shown in FIG. 6.

The lens holders 2 in the cassette 31 slide on the holder storing cassette 31 and chutes 30 by their own weights. When the lens holders 2 are sequentially discharged one by one by a shutter mechanism 38, they are supported by the holder support mechanism 29 shown in FIGS. 5 and 8.

Referring to FIGS. 4 and 8, the shutter mechanism 38 has a pair of stopper pins 39 for locking a first lens holder 2A by normally closing a discharge port 30*a* of the chute 30, and an air cylinder 40 for vertically moving the stopper pins 39. When the air cylinder 40 is driven by a supply signal from a controller (not shown), the lens holder 2 is discharged from the chute 30. More specifically, when the air cylinder 40 is driven to move the stopper pins 39 downward so as to be retreated from the path of the chute 30, the first lens holder 2A is released from the stopper pins 39, so it is discharged from the discharge port 30*a* of the chute 30 by its own weight and moves onto a terminal end 30*b*. The terminal end 30*b* is set with a small angle of inclination in order to decrease the slide speed of the lens holder 2 and to decrease the impact produced when the lens holder 2 abuts against a stopper 47 (to be described later) of the holder support mechanism 29. When the first lens holder 2A passes, the stopper pins 39 are moved upward to restore to the initial state. Thus, after sliding on the chutes 30 until the positions of the stopper pins 39, a second lens holder 2B is locked by the stopper pins 39, and serves as a new first lens holder. This operation is repeated so the lens holders 2 are automatically supplied one by one. The chute 30 is formed substantially identical to the cassette 31, and is fixed on the base 21. Sensors 41 (FIG. 4) for detecting the absence/presence of the lens holders 2 are attached to two portions, i.e., the downstream and intermediate portions, of the chute 30. The upstream sensor 41 is turned on when the number of lens holders 2 left in the chute 30 is 9, and prompts the operator to replenish. The downstream sensor 41 is turned on when the number of lens holders 2 left in the chute 30 is 1, and stops the layout blocker.

Figure 11A:
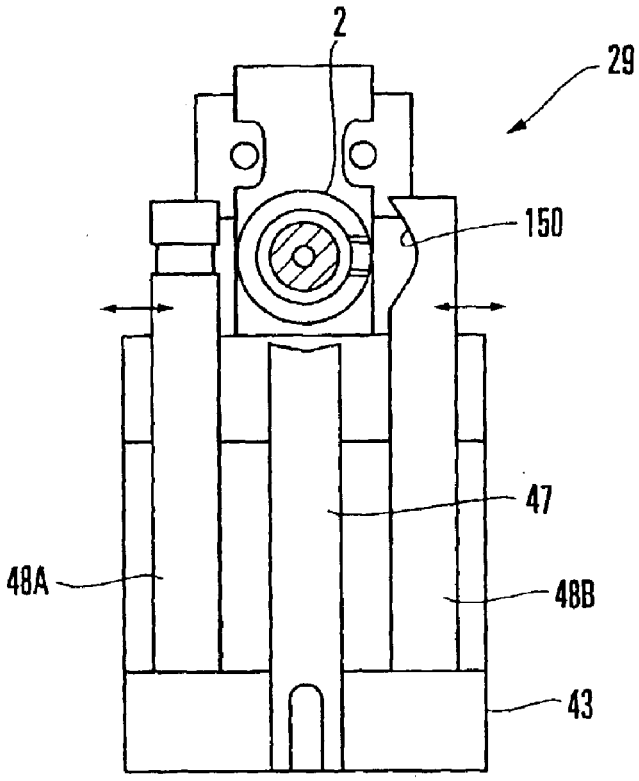
FIGS. 11(*a*) and 11(*b*) are a plan and front views, respectively, of a holder support mechanism.
Figure 11B:
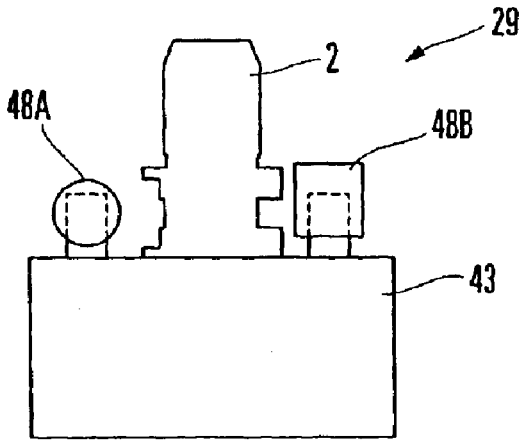

Referring to FIGS. 5, 8, and 11, the holder support mechanism 29 is disposed on the base 21 to oppose the terminal end of the chutes 30, and has a stage 43 which is movable in the back-and-forth direction of the ABS 20 (direction of the arrow Y of FIG. 5) to reciprocally move between terminal end positions A1, A2, and A3 of the chutes 30 and a holder mounting position A4. The stage 43 is movably held by a pair of left and right rails 44 and a ball screw 45 which are formed on the base 21. When a driving motor 46 is driven to rotate the ball screw 45, the stage 43 moves along the rails 44 and ball screw 45. The terminal ends 30*b* of the chutes 30 are positioned at the terminal end positions A1, A2, and A3 of the respective chutes 30.

A stopper 47 for receiving the lens holder 2 supplied to the terminal end 30*b* of the chute 30, a pair of holder hands 48A and 48B for supporting the lens holder 2, and an air cylinder 49 for actuating the holder hands 48A and 48B in synchronism to move in directions to be close to and separate from each other are disposed on the upper surface of the stage 43. One holder hand 48A is formed of a rod-like member with a circular section, and holds the rotation preventive portion 11 of the lens holder 2 with the outer surface of its distal end. The other holder hand 48B is formed of a rod-like member with a rectangular section, and has a V-shaped recess 50 in that side surface of its distal end which opposes the lens holder 2. The recess 50 holds the outer surfaces of the flange 5 and lens holding portion 6 on that side of the lens holder 2 which is opposite to the rotation preventive portion 11.

Figure 12:
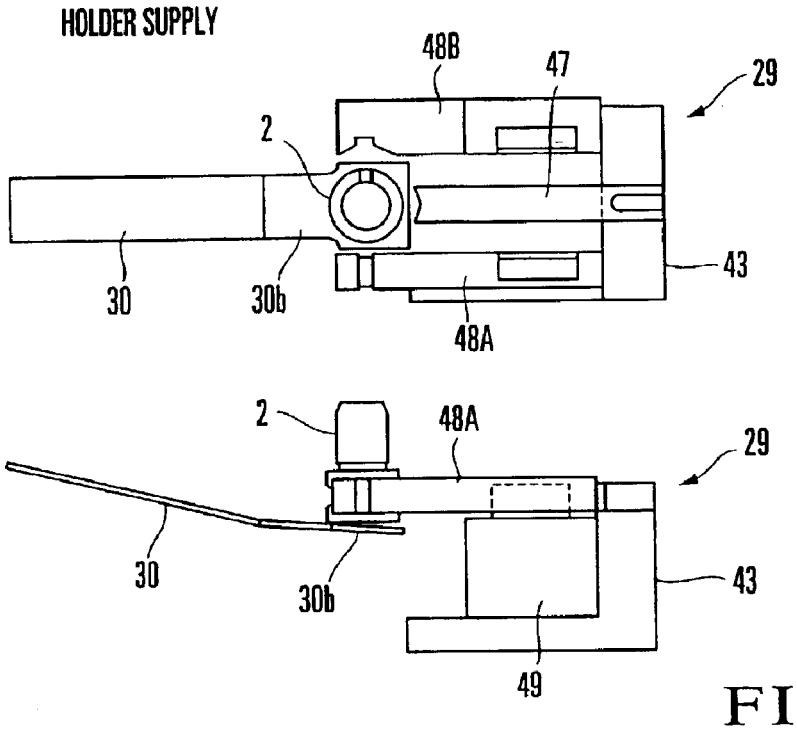
FIG. 12 is a view showing lens holding operation performed by the holder support mechanism.
Figure 13:
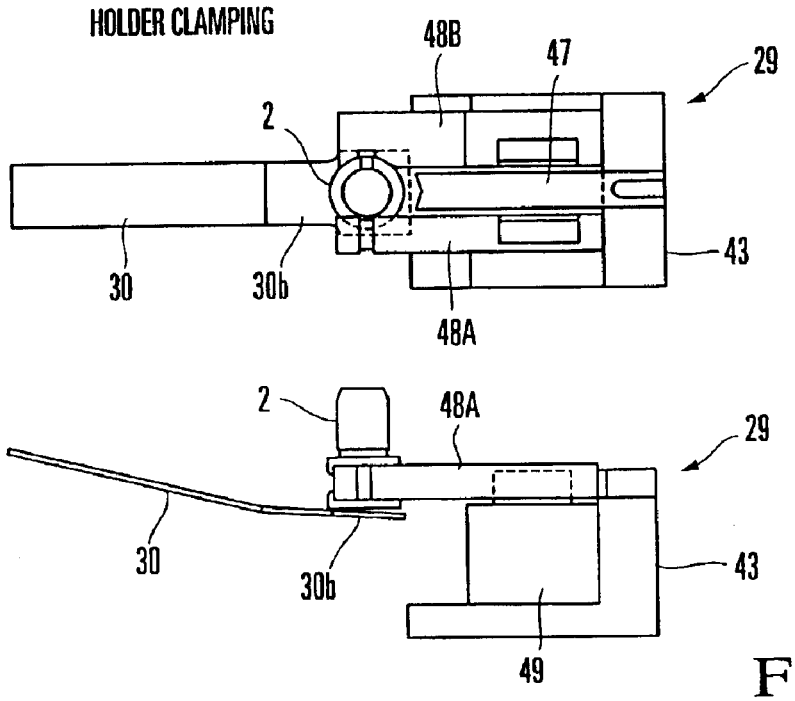
FIG. 13 is a view showing lens holding operation performed by the holder support mechanism.

When the lens holder 2 is to be supplied, the stage 43 described above has moved in advance to the terminal position of that chute of the three chutes 30 to which the lens holder 2 is to be supplied, i.e., the position A1, and waits there with the holder hands 48A and 48B being open (FIG. 12). When the lens holder 2 is supplied onto the terminal end 30*b* of the chute 30, the stopper 47 receives it, and the pair of holder hands 48A and 48B are closed to clamp it (FIG. 13). After that, the clamped lens holder 2 is conveyed to the holder mounting position A4, and centering of the lens holder 2 is performed.

Figure 14A:
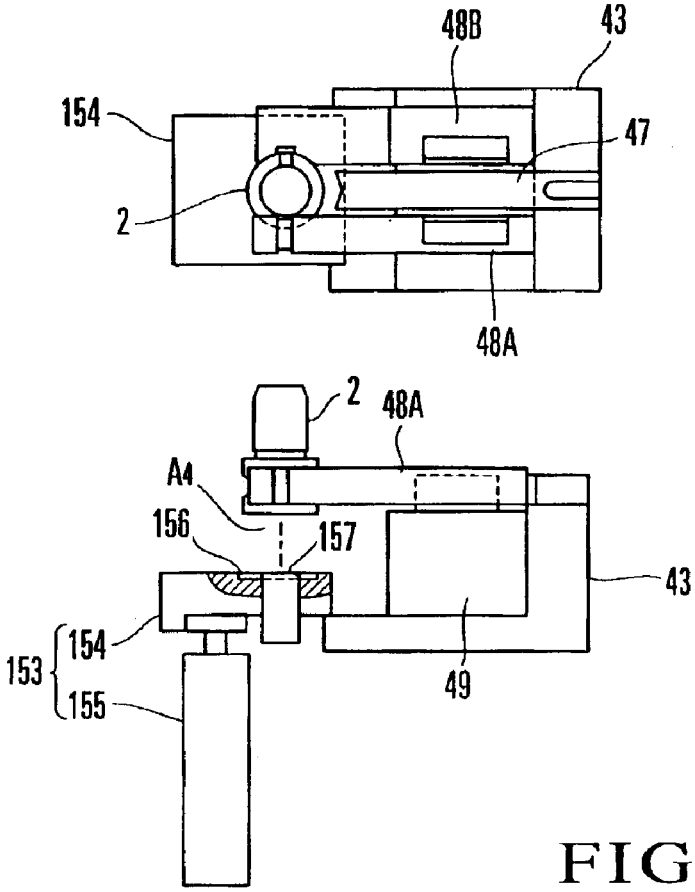
FIGS. 14(*a*) and 14(*b*) are views showing centering operation for the lens holder performed by a centering mechanism.
Figure 14B:
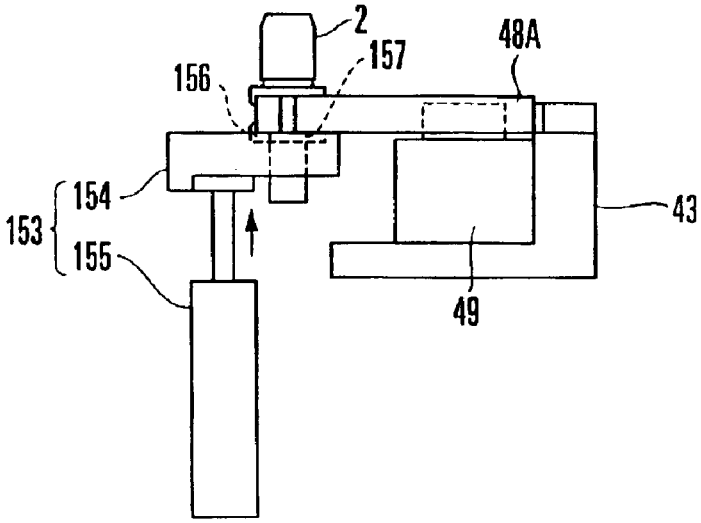

Referring to FIG. 14, a centering mechanism 153 is disposed at the holder mounting position A4 to perform centering of the lens holder 2 supported by the holder hands 48A and 48B. The centering mechanism 153 is constituted by an elevating table 154 and an air cylinder 155 for vertically moving the elevating table 154. The upper surface of the elevating table 154 has a comparatively shallow recess 56 with a hole diameter slightly larger than the outer diameter of the lens holding portion 6 of the lens holder 2. A circular projection 157 is formed at the center of the recess 156, and has a diameter slightly smaller than a central hole 7 (FIGS. 1 and 3) of the lens holder 2. The elevating table 154 is usually located substantially immediately below the lens holder 2 to be separate from it (FIG. 14(*a*)). In centering the lens holder 2, when the air cylinder 155 is driven to move the elevating table 154 upward (FIG. 14(*b*)), the recess 156 receives the lens holding portion 6 of the lens holder 2, and the projection 157 fits in the central hole 7 so the center of the lens holder 2 and that of the projection 157 coincide with each other, thereby centering the lens holder 2. At this time, the air cylinder 49 is deenergized to make the pair of the holder hands 48A and 48B flexible, thus enabling centering, so the lens holder 2 is held to be movable in the left-and-right and back-and-forth directions. After the lens holder 2 is centered, the elevating table 154 moves downward successively to restore to the original initial position, thus ending centering.

Referring to FIG. 5 and FIGS. 15 to 17, the holder holding unit 23 is disposed, on a side of the holder support mechanism 29, in a space between the seal supply unit 24 (FIG. 5) and lens supply unit 25. At the holder mounting position A4, when the holder holding unit 23 receives the lens holder 2 centered from the holder support mechanism 29, it conveys the lens holder 2 to a seal adhering position A5 to adhere the elastic seal 3 to the lens holding surface 9 of the lens holder 2 it holds. After that, the holder holding unit 23 conveys the lens holder 2 to a lens holding position A6, so the lens 1 is held by the elastic seal 3. The holder holding unit 23 has a pivotal arm 160 (FIG. 15), a clamp unit 161 attached to the distal end of the pivotal arm 160 to hold the lens holder 2, an arm driving motor (arm driving unit) 162 for pivoting the pivotal arm 160 within a horizontal plane, a clamp air cylinder (clamp driving unit) 163 for vertically moving the clamp unit 161, and the like.

The pivotal arm 160 is fixed to the upper end of a vertical rotating shaft 165 standing upright on the base 21. The rotating shaft 165 is disposed in a cylinder 166, standing upright on the base 21, to be rotatable through radial bearings 167 and thrust bearing 168. A toothed pulley 169 is fixed to the lower end of the rotating shaft 165. The driving motor 162 is vertically fixed to an attaching member 170 formed on the base 21, with its output shaft 171 facing up. The output shaft 171 is connected to a shaft 172 through a coupling 173. The shaft 172 has a toothed pulley 174. A timing belt 175 extends between the pulleys 174 and 169. When the driving motor 162 is driven to rotate the output shaft 171, this rotation is transmitted to the rotating shaft 165 through the coupling 173, shaft 172, pulley 174, timing belt 175, and pulley 169, so it can pivot the pivotal arm 160 within a horizontal plane. The pivot angle of the pivotal arm 160 is 300° in this embodiment.

The clamp unit 161 is constituted by a cylindrical main body 82 to fit on the fitting shaft portion 4 of the lens holder 2, a holder fixing mechanism 83 for fixing the lens holder 2 to the main body 82 to prevent it from removing, and the like. The main body 82 is fixed to the lower end of a holding shaft 85 disposed to the distal end of the pivotal arm 160 to be vertically movable and rotatable. The holder fixing mechanism 83 has a holder fixing member 84 axially supported by a support pin 86, formed on the main body 82, to be pivotal in the direction of an arrow 87 in FIG. 15, and the like. The holder urging member 84 fixes the lens holder 2 to the main body 82 by urging, has an urging portion 84*a* at its lower end to urge the fitting shaft portion 4 of the lens holder 2, is disposed in an elongated hole 88 formed in the outer surface of the main body 82 and long in the axial direction, and is biased by a tension coil spring 89 counterclockwise in FIG. 13. Thus, usually, the urging portion 84*a* projects to the outside of the main body 82. This allows the lens holder 2 to be fitted in the main body 82 easily.

Furthermore, the holder fixing mechanism 83 has an air cylinder 90 for operating the holder fixing member 84. The air cylinder 90 is attached to the outer surface of the main body 82 with its operational rod 90*a* opposing the holder fixing member 84. When the fitting shaft portion 4 of the lens holder 2 is fitted in the main body 82, air is supplied to the air cylinder 90 to actuate it. Thus, the movable rod 90*a* urges the holder fixing member 84 to pivot it clockwise against the tension coil spring 89. Therefore, the urging portion 84*a* of the holder fixing member 84 urges the fitting shaft portion 4 of the lens holder 2 against the inner surface of the main body 82, thereby preventing the lens holder 2 from being removed.

The shaft 85 extends through an outer cylinder 94 fixed to the distal end of the pivotal arm 160 to be vertically movable and rotatable. The upper end of the shaft 85 is connected to the clamp air cylinder 163 through a coupling 95, and the lower end thereof extends through a sleeve 102, disposed in the lower portion of the interior of the outer cylinder 94, to be rotatable and vertically movable. The coupling 95 is constituted by a columnar first coupling 95A fixed to the movable rod 63*a* of the air cylinder 163, and a cylindrical second coupling 95B connected to the first coupling 95A through a connection pin 96. The coupling 95 rotatably axially supports the upper end of the shaft 85 with bearings 97 disposed in the second coupling 95B, and prevents the shaft 85 from dropping from the second coupling 95B with a set screw 98. The two ends of the connection pin 96 are slidably supported by an inner cylinder 100 arranged in the outer cylinder 94 to project upward. This prevents rotation of the second coupling 95B. A pair of guide holes 101 for guiding the connection pin 96 are formed in the wall portions of the inner cylinder 100 to be long in the axial direction. When the air cylinder 163 is driven to move the movable rod 163*a* downward, the clamp unit 161 is moved downward together with the shaft 85.

A driving motor 105 for pivoting the clamp unit 161 is set on the upper surface of the pivotal arm 160 to face down. The driving motor 105 serves to pivot the clamp unit 161 in accordance with the angle of cylinder axis. An output shaft 105*a* of the driving motor 105 is connected to the upper end of a driven shaft 107 through a coupling 106. The driven shaft 107 is rotatably axially supported by bearings 108 provided to an attaching member 110, and a small-diameter gear 109 is fixed to its intermediate portion. The attaching member 110 is fixed to the pivotal arm 160. A transmission shaft 111 is disposed on a side of the driven shaft 107 to be parallel to it. The transmission shaft 111 is rotatably axially supported by bearings 112 provided to an attaching member 115. A toothed pulley 113 is fixed to the upper end of the transmission shaft 111, and a large-diameter gear 114 to mesh with the small-diameter gear 109 is fixed to the intermediate portion of the transmission shaft 111. The attaching member 115 is fixed to the pivotal arm 160.

A toothed pulley 116 is disposed at the intermediate portion of the shaft 85 to correspond to the toothed pulley 113. A timing belt 117 extends between the pulleys 113 and 116. The toothed pulley 116 is disposed between the inner cylinder 100 and sleeve 102 to be rotatable through bearings 119, and is attached to the shaft 85 through spline fitting to be slidable relative to it. Hence, a groove 120 long in the axial direction is formed in the outer surface of the shaft 85. A projection to slidably fit in the groove 120 projects from the inner surface of the toothed pulley 116. Therefore, rotation of the driving motor 105 is decelerated by the gears 109 and 114, and is transmitted to the shaft 85 through the toothed pulleys 113 and 116 and timing belt 117, to pivot the clamp unit 161 through the angle of cylinder axis.

An origin sensor 121 for positioning the shaft 85 at the position of origin and a limit sensor 122 for limiting the pivot range of the shaft 85 to 360° are disposed on the outer cylinder 94.

An arm fixing unit 127 is attached to the cylinder 166 through an attaching plate 128. A rotation preventive member 129 is fixed to the lower surface of the pivotal arm 160 to correspond to the arm fixing unit 127. Upon pivot motion of the pivotal arm 160, when the clamp unit 161 is moved to the lens holding position A6 and is stopped there, the arm fixing unit 127 temporarily fixes the pivotal arm 160 at this pivot position, to prevent rotation of the clamp unit 161 when the clamp unit 161 is urged against the lens 1. An air cylinder is used as this arm fixing unit 127, and is fixed to the attaching plate 128 with its movable rod 127*a* facing up. An inverted V-shaped engaging member 130 is attached to the upper end of the movable rod 127*a*. A V-shaped groove 129*a* is formed in the lower surface of the rotation preventive member 129, and engages with the engaging member 130 when the clamp unit 161 moves to the lens holding position A6 and stops there.

Figure 16:
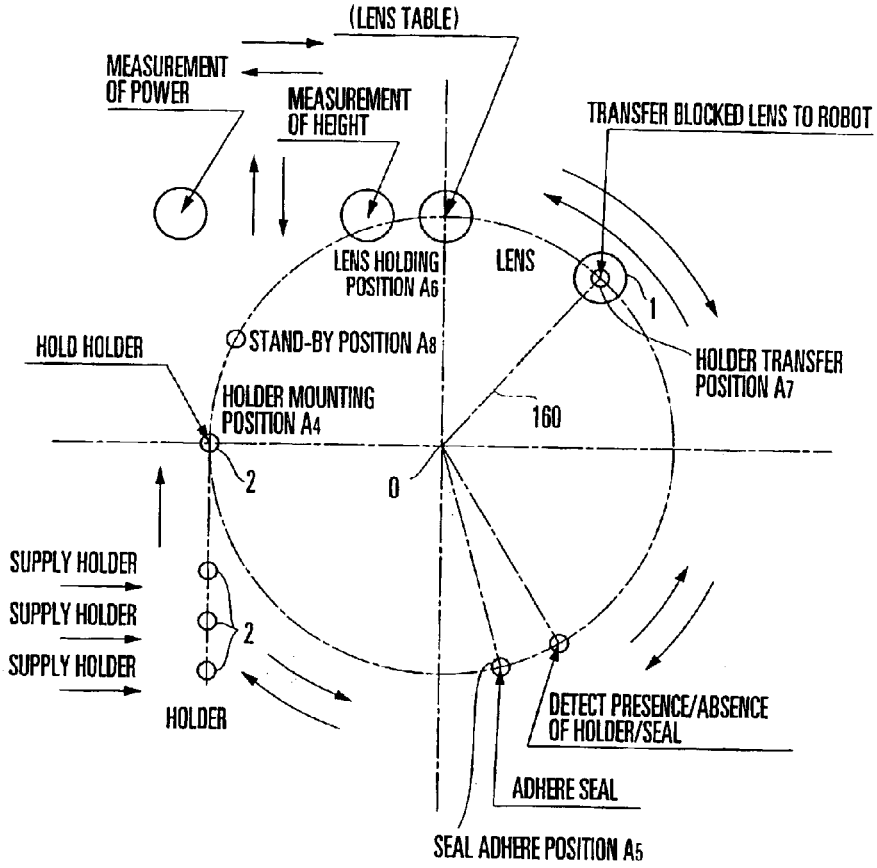
FIG. 16 is a view showing a relationship among seal positions, i.e., a holder mounting position A4, seal adhering position A5, lens holding position A6, holder transfer position A7, and stand-by position A8.

As shown in FIG. 16, the holder mounting position A4, the seal adhering position A5, the lens holding position A6, and a holder transfer position A7 are formed to be located on one circumference with a rotation center O of the pivotal arm 160 as the center and a radius corresponding to the distance to the clamp unit 161. The holder mounting position A4 is where the clamp unit 161 receives the lens holder 2 from the holder support mechanism 29 and holds it. The seal adhering position A5, holder transfer position A7, and lens holding position A6 are shifted from the holder mounting position A4 counterclockwise by 120°, 230°, and 270°, respectively. The seal adhering position A5 is where the elastic seal 3 is adhered to the lens holder 2 held by the 1clamp unit 61. The lens holding position A6 is where the lens 1 is held by the lens holder 2, held by the clamp unit 161, through the elastic seal 3. The holder transfer position A7 is where the lens holder 2 (held by the clamp unit 161) that holds the lens 1 is transferred to a convey robot so it is supplied to the edger. A stand-by position A8 where the clamp unit 161 is set in the stand-by state is formed between the holder mounting position A4 and lens holding position A6.

Figure 15:
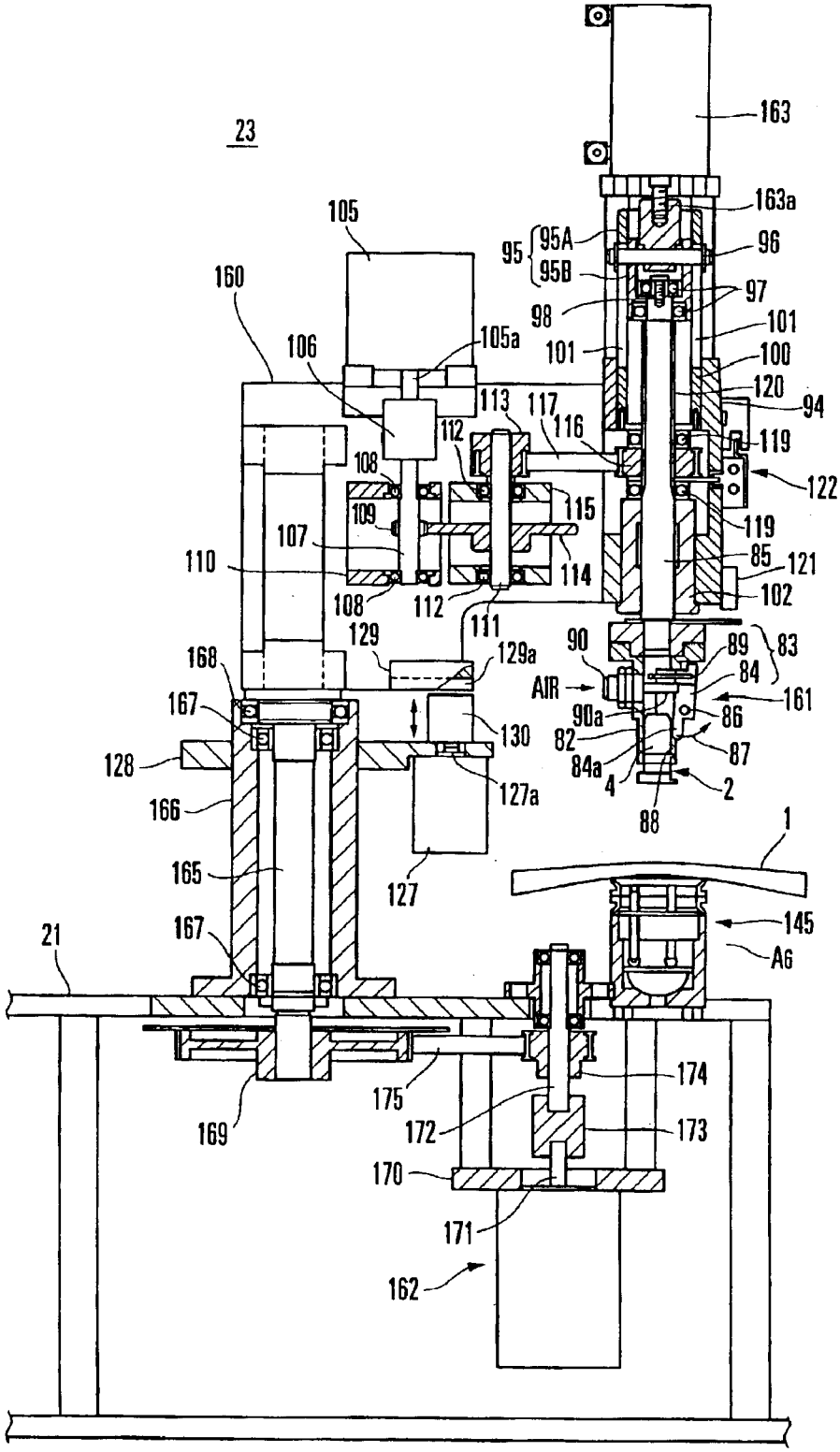
FIG. 15 is a sectional view of a holder holding unit.
Figure 17A:
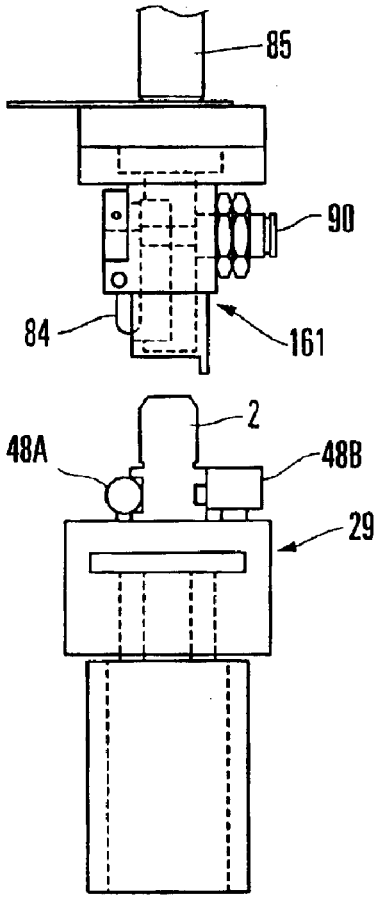
FIGS. 17(*a*) and 17(*b*) are views showing holding operation for the lens holder performed by a clamp unit.
Figure 17B:
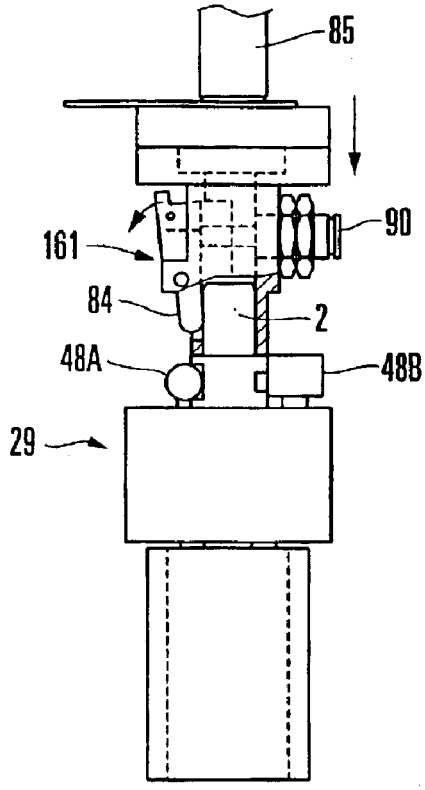

When the clamp unit 161 is to hold the lens holder 2, the pivotal arm 160 is pivoted to move the clamp unit 161 to above the holder mounting position A4, as shown in FIG. 17 (FIG. 17(*a*)). When the clamp unit 161 is stopped above the holder mounting position A4, the air cylinder 163 (FIG. 15)

is driven to move the shaft 85 downward, and the main body 82 of the clamp unit 161 is fit on the fitting shaft portion 4 of the lens holder 2 from above (FIG. 17(*b*)).

Subsequently, the air cylinder 90 is driven to pivot the holder fixing member 84 clockwise against the tension coil spring 89, so the urging portion 84*a* of the holder fixing member 84 is urged against the fitting shaft portion 4. When the holder arms 48A and 48B of the holder support mechanism 29 are opened to release the lens holder 2, the lens holder 2 is held by the clamp unit 161. Thus, transfer of the lens holder 2 from the holder support mechanism 29 to the clamp unit 161 is ended. The clamp unit 161 moves upward again, to convey the lens holder 2 it holds to the seal adhering position A5 with the pivot motion of the pivotal arm 60.

Referring to FIGS. 4 and 5, the seal supply unit 24 serves to intermittently supply the elastic seal 3 to the seal adhering position A5, and is disposed at the seal adhering position A5 to oppose the holder supply mechanism 28 through the holder support mechanism 29. The elastic seal 3 is loaded in a roll loader 142 in the form of a roll 141 wound around a shaft 140. In this roll 141, the elastic seals 3 are aligned in a line on a mount 253 (FIG. 18) at predetermined gaps, and their upper surfaces are covered with a protector paper 254. Each elastic seal 3 is supplied to the seal adhering position A5 as the protector paper 254 is separated from it.

When the elastic seal 3 is supplied to the seal adhering position A5 and is stopped, the clamp unit 161 is moved, upon pivot motion of the pivotal arm 160, to above the seal adhering position A5, and is stopped. Subsequently, the clamp unit 161 moves downward to urge the lens holding surface 9 of the lens holder 2 against the upper surface of the elastic seal 3, so the projections 10 bite the elastic seal 3. The clamp unit 161 is moved upward, so the elastic seal 3 is separated from the mount 253 and is adhered to the lens holding surface 9. When the elastic seal 3 is adhered to the lens holding surface 9, the pivotal arm 160 pivots through a predetermined angle counterclockwise in FIG. 5 to move the lens holder 2 held by the clamp unit 161 to the lens holding position A6. During this movement, whether the lens holder 2 and elastic seal 3 are present or not is detected. When the lens holder 2 is moved to the lens holding position A6 and is stopped, it is moved downward to urge the elastic seal 3 adhered to the lens holder 2 against the lens 1 supplied to the lens holding position A6, so that the elastic seal 3 comes into tight contact with the lens 1. Therefore, the lens 1 is held by the lens holder 2 through the elastic seal 3. FIG. 2 shows this state. A lens support unit 145 (FIG. 15) for supporting the lens 1 supplied by the lens supply unit 25 (FIG. 5) is disposed at the lens holding position A6.

The urging force with which, at the blocking position A6, the elastic seal 3 adhered to the lens holding surface 9 of the lens holder 2 is urged against the lens 1 to adhere the lens 1 to the elastic seal 3 is smaller than the urging force with which, at the seal adhering position A5, the lens holder 2 is urged against the elastic seal 3 to adhere the elastic seal 3 to the lens holding surface 9. This switching of the urging force is performed by an urging force change unit 255. Switching of the urging force by the urging force change unit will be described in more detail with reference to FIGS. 18 and 19.

Figure 18:
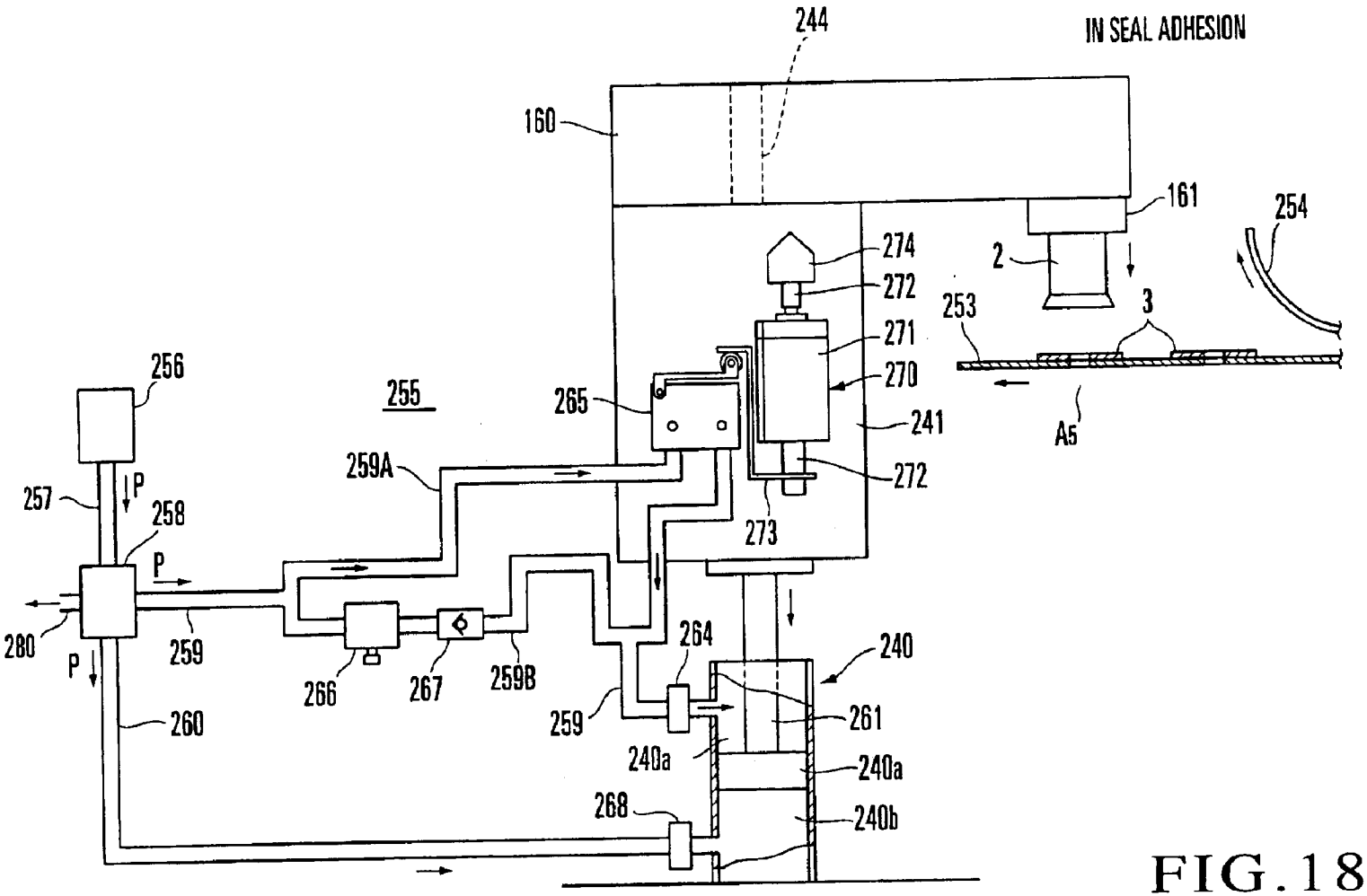
FIG. 18 is a view showing operation performed when adhering an elastic seal to the lens holder.
Figure 19:
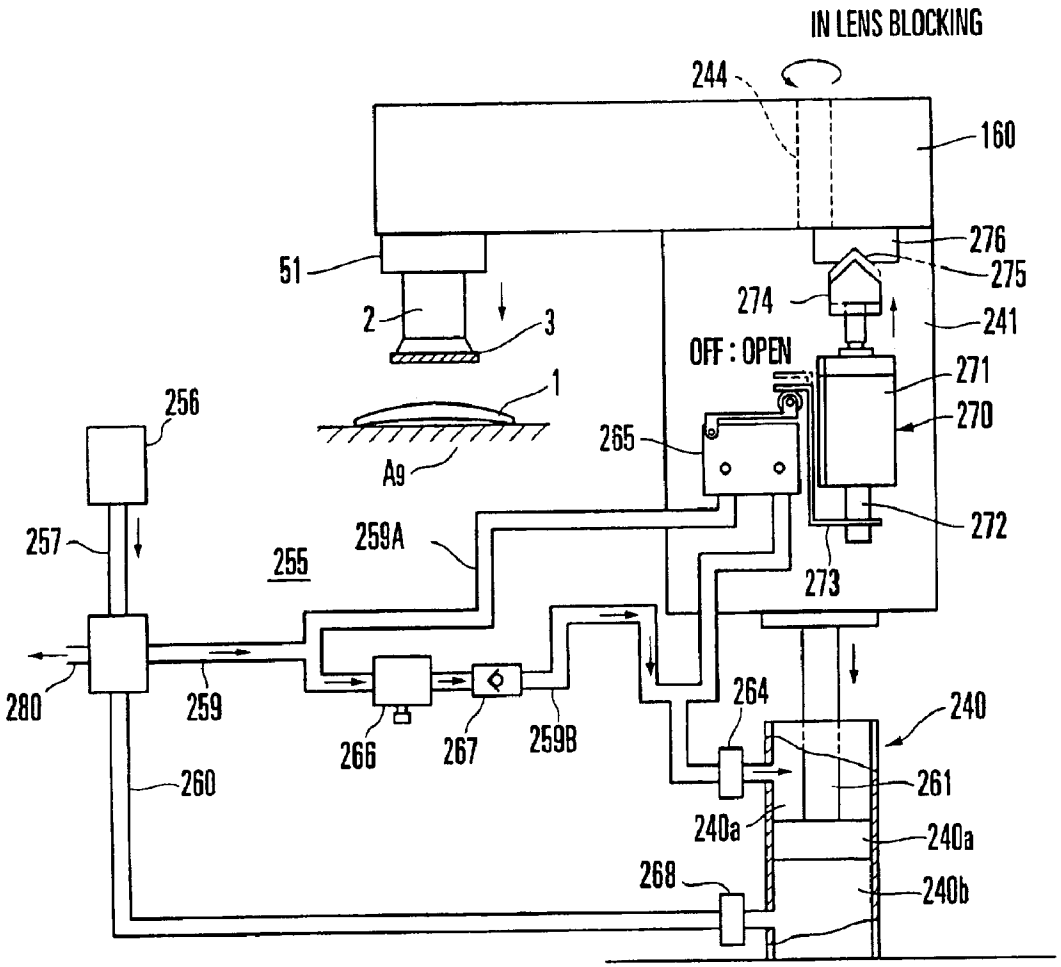
FIG. 19 is a view showing operation performed when adhering a lens to the elastic seal.

Referring to FIGS. 18 and 19, reference numeral 240 denotes an air cylinder; and 241, a support column 2 vertically moved by the air cylinder 240. The pivotal arm 50 is pivotally disposed on the upper surface of the support column 241. Reference numeral 244 denotes a shaft for axially supporting the pivotal arm 160.

The urging force change unit 255 has the air cylinder 240, an air supply source 256 for supplying compressed air to the air cylinder 240, a selector valve 258 connected to the air supply source 256 through a pipe 257, pipes 259 and 260 for connecting the selector valve 258 and air cylinder 240 to each other, and the like. The support column 241 is set and fixed to the outer end of a piston rod 261 of the air cylinder 240.

Figure 20A:
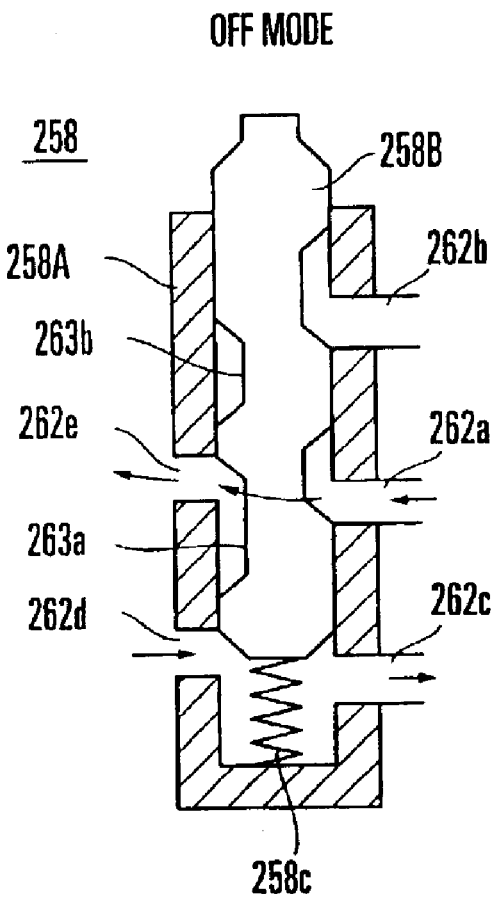
FIGS. 20(*a*) and 20(*b*) are views showing turn-on and turn-off operations of a selector valve.
Figure 20B:
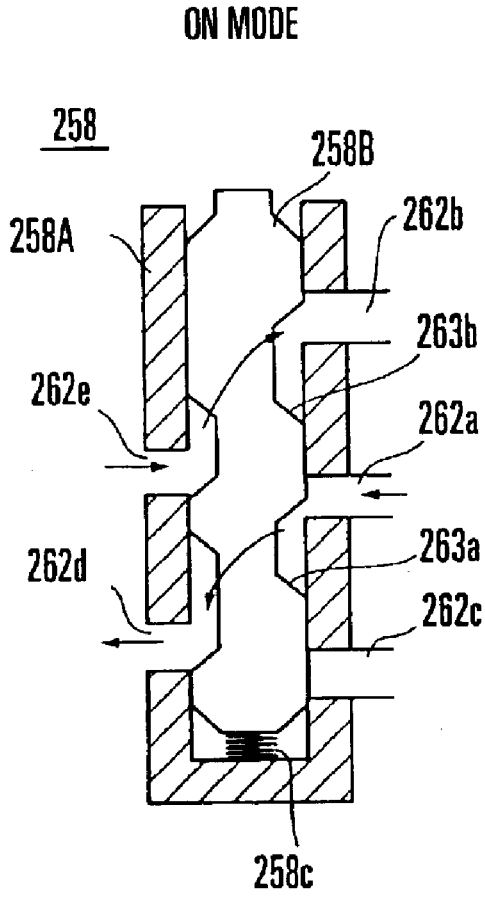

The selector valve 258 is turned on/off by a solenoid, and has a cylinder 258A, a spool 258B slidable in the cylinder 258A, and a compression coil spring 258C for biasing the spool 258B in a direction to project from the cylinder 258A, as shown in FIG. 20. The cylinder 258A has five ports 262*a* to 262*e*, and the spool 258B has two annular grooves 263*a* and 263*b*. The port 262*a* is connected to the air supply source 256, and the ports 262*b* and 262*c* form an exhaust port through which the compressed air returning from the air cylinder 240 is exhausted to the atmosphere. The ports 262*d* and 262*e* are connected to an upper chamber 240*a* and lower chamber 240*b* of the air cylinder 240 through the pipes 259 and 260, respectively.

When the selector valve 258 is OFF as shown in FIG. 20(*a*), the spool 258B is held by the force of the compression coil spring 258C to project from the cylinder 258A. In this OFF state, the ports 262*a* and 262*e* communicate with each other through the annular groove 263*a*, the port 262*b* is closed, and the ports 262*c* and 262*d* communicate with each other through the cylinder 258A. When the selector valve 258 is driven by a driving signal from the controller and is switched to the ON state shown in FIG. 20(*b*), the spool 258B is retracted into the cylinder 258A against the compression coil spring 258C. In this ON state, the ports 262*a* and 262*d* are connected to each other through the annular groove 263*a*, the ports 262*b* and 262*e* are connected to each other through the annular groove 263*b*, and the port 262*c* is closed.

The upstream end of the pipe 259 is connected to the port 262*d* of the selector valve 258, and the downstream end thereof is connected to that chamber (upper chamber) 240*a* of the air cylinder 240 which is above a piston 240A. This downstream end of the pipe 259 also has a speed controller 264 for controlling the flow velocity with which the compressed air in the upper chamber 240*a* is exhausted.

The pipe 259 also has high-pressure and low-pressure branch pipes 259A and 259B midway along it. A selector valve 265 is connected to the high-pressure branch pipe 259A, while a pressure reducing valve (fluid pressure switching means) 266 and check valve 267 are connected to the low-pressure branch pipe 259B.

The upstream end of the other pipe 260 is connected to the port 262*e* of the selector valve 258, and the downstream end thereof is connected to that chamber (lower chamber) 240*b* of the air cylinder 240 which is below the piston 240A. This downstream end of the pipe 260 also has a speed controller 268 for controlling the flow velocity with which the compressed air in the lower chamber 240*b* is exhausted.

A pressure (main pressure) P of the compressed air supplied from the air supply source 256 to the pipes 259 and 260 through the selector valve 258 is, e.g., 5 kgf/cm$^2$, and is reduced to, e.g., 3 kgf/cm$^2$ by the pressure reducing valve 66.

The selector valve 265 is fixed to the support column 241, and is turned on/off by the driving operation of an air cylinder 270 different from the air cylinder 240. In seal adhesion of urging the lens holder 2 against the elastic seal 3 so the elastic seal 3 is adhered to the lens holding surface 3, the selector valve 265 is held in the ON state (FIG. 18) At this time, v the selector valve 258 is also switched to the ON state. In the ON state, the high-pressure branch pipe 259A is open, and the compressed air from the air supply source 256 flows through the port 262*a* of the selector valve 258, the annular groove 263*a*, the port 262*d*, the high-pressure branch pipe 259A, the selector valve 265, and the speed controller 264 to be supplied to the upper chamber 240*a* of the air cylinder 240. In lens adhesion of urging the elastic seal 3 adhered to the lens holder 2 against the lens 1 so the lens 1 is adhered to the elastic seal 3, the selector valve 265 is held in the OFF state (FIG. 19) At this time, the selector valve 58 is held in the ON state. When the selector valve 265 is switched to the OFF state, the high-pressure branch pipe 259A is disconnected, and air from the air supply source 256 flows through 262*a* of the selector valve 258, the annular groove 263*a*, the port 262*d*, the low-pressure branch pipe 259B, the pressure reducing valve 266, the check valve 267, and the speed controller 264 to be supplied to the upper chamber 240*a* of the air cylinder 240.

The air cylinder 270 switches the selector valve 265. Also, when the clamp unit 51 is moved to the blocking position A6 and stopped, the air cylinder 270 temporarily fixes the pivotal arm 160 at this pivot position. Accordingly, when the elastic seal 3 is urged against the lens 1, the pivotal arm 160 is prevented from pivoting to be positionally displaced. The air cylinder 270 has a cylinder body 271 fixed to the support column 241, and a piston rod 272 extending through the cylinder body 271. The piston rod 272 has an actuating member 273 at its lower end to turn on/off the selector valve 265. A locking member 274 with an inverted V-shaped upper surface is attached to the upper end of the piston rod 272. To correspond to the locking member 274, a rotation preventive member 276 with a V-shaped groove 275 is fixed to the lower surface of the pivotal arm 160. The rotation preventive member 276 is attached to such a position that, when the clamp unit 161 moves to above the blocking position A6, it opposes the locking member 274.

Referring to FIG. 18, upon pivot motion of the pivotal arm 160, the clamp unit 161 is moved above the seal adhering position A5 and stopped, to adhere the elastic seal 3 to the lens holder 2. At this time, since the selector valve 265 is held in the ON state, the compressed air supplied from the air supply source 256 flows through the port 262*a* of the selector valve 258, the annular groove 263*a*, the port 262*d*, the high-pressure branch pipe 259A, the selector valve 265, and the speed controller 264 to be supplied to the upper chamber 240*a* of the air cylinder 240. The supplied air pushes down the piston 240A to urge the lens holder 2 against the elastic seal 3. At this time, the compressed air in the lower chamber 240*b* flows through the pipe 260 and then through the port 262*e* of the selector valve 258, the annular groove 263*b*, and the port 262*b* to be exhausted to the outside from an exhaust pipe 280.

The urging force with which the lens holder 2 is urged against the elastic seal 3 is 5 kgf/cm$^2$, which is equal to the preset pressure of the air supply source 256. Air supplied from the air supply source 56 is also supplied to the low-pressure branch pipe 259B, and is reduced to 3 kgf/cm$^2$ by the pressure reducing valve 266. As the high-pressure compressed air from the high-pressure branch pipe 259A is added to the downstream of the check valve 267, this pressure-reduced air will not open the check valve 267.

After the lens holding surface 9 of the lens holder 2 is urged against the elastic seal 3 so the elastic seal is adhered to it, the selector 2 valve 58 is switched to the OFF state. The compressed air from the air supply source 256 flows through the port 262*a* of the selector valve 258, the annular groove 263*a*, the port 262*e*, the pipe 260, and the speed controller 268 to be supplied to the lower chamber 240*b* of the air cylinder 240. The compressed air in the upper chamber 240*a* flows through the speed controller 264, the low-pressure branch pipe 259B, the check valve 267, the pressure reducing valve 266, the port 262*d* of the selector valve 258, and the port 262*c* to be exhausted to the atmosphere from the pipe 280. Hence, the piston 240A moves upward to restore to the original height position. Therefore, the lens holder 2 moves upward together with the support column 241 and pivotal arm 50, and the elastic seal 3 is separated from the mount 253 and adhered to the lens holding surface of the lens holder 2.

When adhesion of the elastic seal 3 to the lens holder 2 is ended, the pivotal arm 160 pivots through a predetermined angle, as shown in FIG. 19, to move the lens holder 2 adhered with the elastic seal 4 to above the blocking position A6, and stops it there. When the pivotal arm 160 is stopped, the air cylinder 270 is driven to move the piston rod 272 upward, so the locking member 274 engages with the V-shaped groove 275 of the rotation preventive member 276. As the piston rod 272 moves upward, the actuating member 273 separates from the selector valve 265. Thus, the selector valve 265 is turned off to close the high-pressure branch pipe 259A. Also, the selector valve 258 is turned on. After that, the compressed air from the air supply source 256 flows through the port 262*a* of the selector valve 258, the annular groove 263*a*, the port 262*d*, the low-pressure branch pipe 259B, the pressure reducing valve 266, the check valve 267, and the speed controller 264, and is supplied to the upper chamber 240*a* of the air cylinder 240, to move the support column 241 and pivotal arm 160 downward. Accordingly, the elastic seal 3 is urged against the lens 1, thereby adhering the lens 1 to the elastic seal 3. The urging force at this time is 3 kgf/cm$^2$, as the compressed air supplied from the air supply source 256 is supplied to the upper chamber 40*a* after it is reduced by the pressure reducing valve 266.

After the lens 1 is adhered to the elastic seal 3, the lens holder 2 is moved upward to be restored. At this time, the selector valve 258 is turned off, in the same manner as in seal adhesion, and the compressed air from the air supply source 256 flows through the port 262*a* of the selector valve 258, the annular groove 263*a*, the port 262*e*, the pipe 260, and the speed controller 268, to be supplied to the lower chamber 240*b* of the air cylinder 240. Thus, the compressed air in the upper chamber 240*a* flows through the speed controller 264, the low-pressure branch pipe 259B, the check valve 267, the pressure reducing valve 266, the port 262*d* of the selector valve 258, and the port 262*c*, to be exhausted to the atmosphere from the exhaust pipe 280. For this reason, the piston 240A moves upward to restore to the original height position, and the adhering process of the lens 1 is ended.

Referring to FIGS. 4 and 5, the lens supply unit 25 holds the unexamined lens supplied to the blocking position A6 and supplies it to the lens meter 26. When the lens meter ends measurement of the lens, the lens supply unit 25 conveys the lens to the blocking position A6 again. The lens supply unit 25 has three tables movable in three orthogonal directions (X-, Y-, and Z-axis directions) independently of each other, i.e., a Y-table 58 which is moved in the Y-axis direction by two guide rails 56 and a ball screw 57, an X-table 61 set on the Y-table 58 through two guide rails 59 and a ball screw 60 so as to be movable in the X-axis direction, and a Z-table 62 set on the X-table 61 and movable in the Z-axis direction, driving motors (not shown) for driving these tables, and the like. The Z-table 62 has a pair of left and right hands 63A and 63B, and holds the edge of the lens 1 supplied to the lens supply unit 25 at four points with these hands. Upon receiving the lens 1 supplied to the lens supply unit 25 and holding it, the pair of hands 63A and 63B convey it to the lens meter 26. Measurement of the lens is performed. When measurement is ended, the hands 63A and 63B move to the lens holding position A6 and place the lens 1 on the lens support unit 145. During this period of time, the height of the concave lens surface of the lens is measured.

The lens meter or measuring device 26 measures the lens power, optical center, cylinder axis, and the like of the unexamined lens 1 supplied to the lens supply unit 25, performs optical layout of the lens 1, and calculates and determines the attaching position, angle, and the like of the lens holder 2 with respect to the lens 1 on the basis of the lens frame shape data.

The lens measuring device 26 outputs the determined result to the controller.

The lens 1 measured by the lens meter 26 is conveyed to the blocking position A6. The elastic seal 3 adhered to the lens holder 2 is urged against the lens 1, as described above, so the lens 1 is held by the lens holder 2. The lens holder 2 that holds the lens 1 is conveyed to the holder transfer position A7 upon pivot motion of the pivotal arm 160, and is removed from the clamp unit 161. The lens holder 2 is then held by an appropriate convey robot, is conveyed to the edger, and is mounted on a clamp shaft 70, as shown in FIGS. 9 and 10. Regarding this, this embodiment performs an arris process in which the outer surface of the lens 1 is cut by an arris cutter 71 to form a V-shaped projection 72 called an arris on the outer surface of the lens.

The lens holder 2 is mounted on the clamp shaft 70 by fitting the proximal end of the fitting shaft portion 4 in a central hole 70*a* of the clamp shaft 70. The flange 5 of the lens holder 2 abuts against the distal end face of the clamp shaft 70. A projecting engaging portion 73 to engage with the rotation preventive portion 8 of the lens holder 2 is integrally formed on the distal end face of the clamp shaft 70. This prevents rotation of the lens holder 2 with respect to the clamp shaft 70. The other clamp shaft 74 is disposed on the other side of the clamp shaft 70 through the lens 1 such that its axis coincides with that of the clamp shaft 70. An urging member 75 formed of an elastic member such as rubber is attached to the distal end face of the clamp shaft 74 to urge the concave lens surface 1*b* of the lens 1. Accordingly, the lens 1 is clamped by the elastic seal 3 and urging member 75. The clamp shafts 70 and 74 are rotated in directions of arrows A and B, respectively, in synchronism with cutting of the lens 1, and are simultaneously moved in a direction (Y direction) perpendicular to the axis on the basis of the lens frame shape data.

In the arris cutter 71, a cutter body 77 and four cutting edges 78 attached to the circumferential surface of the cutter body 77 form a milling cutter. The arris cutter 71 is attached to a shaft 79 parallel to the clamp shafts 70 and 74. As the cutting edge 78, one formed by sintering a diamond sintered body on the surface of a chip made of, e.g., a carbide alloy, is used, and a V-shaped arris groove 84 is formed at the intermediate portion, in the widthwise direction, of its point 78*a*. The arris groove 84 has two types, i.e., a small arris groove and a large arris groove. An arris angle $\alpha$ is about 110° to 125°. An arris height H is, e.g., about 0.4 mm to 0.68 mm in the case of a small arris, and is about 0.7 mm to 0.9 mm in the case of a large arris. A planing cutter may also be used instead.

The arris process of the lens performed by the arris cutter will be described.

First, the lens holder 2 that holds the lens 1 is mounted on one clamp shaft 70. The other clamp shaft 74 is moved forward to urge the urging member 75 against the concave lens surface 1*b* of the lens 1, so the lens 1 is clamped by the elastic seal 3 and urging member 75. A processing program is formed on the basis of the lens frame shape data and is input to the controller of the edger.

A driving unit (not shown) is driven to rotate the arris cutter 71 in the direction of an arrow C so the cutting edges 78 move downward from above. The lens 1 is rotated in the same direction as the arris cutter 71 and is moved simultaneously in the direction of an arrow Y in accordance with the processing program, so that its edge comes into contact with the arris cutter 71. The points 78*a* of the cutting edges 78 bite into the edge of the lens to cut it by a predetermined depth of cut. Finally, a lens with an outline substantially coinciding with the shape of the frame and the arris 72 on its edge is fabricated.

In the above embodiment, the rotation preventive portions 8 and 11 formed on the outer surface of the lens holder 2 are grooves. However, the present invention is not limited to this, and the rotation preventive portions 8 and 11 may be formed of projections.

In this embodiment, the curve difference between the convex lens surface 1*a* of the lens 1 and the lens holding surface 9 is set to at least one curve so the lens holder 2 always abuts against the periphery of the convex lens surface 1*a*. If the curve difference is zero or is up to ±1, it can be covered by the thickness or characteristics of the elastic seal 3.

As is understood from the above description of the embodiment, according to the present invention, the holder holding unit 23 comprising the pivotal arm 160 and the clamp unit 161 attached to the pivotal arm 160 to be vertically movable is provided. Thus, a series of the steps of holding the lens holder 2 at the holder mounting position A4, adhering the elastic seal 3 to the lens holder 2 at the seal adhering position A5, and holding the lens 1 by the elastic seal 3 at the lens holding position A6 can be performed entirely automatically. Therefore, the burden to the operator is reduced considerably, the operating efficiency and productivity are improved, and labor saving can be achieved. During the above steps, since the operator need not hold the lens 1, the lens 1 may not be soiled or damaged. Since the holder mounting position A4, seal adhering position A5, and lens holding position A6 are located on one circumference with the pivotal arm 160 as the center, a large space is not required, and a compact ABS can be provided.

In the above embodiment, the present invention is applied to an ABS for a single-vision lens. However, the present invention is not limited to this, and can also be applied to an ABM for a multifocal lens.

In the above embodiment, the holder fixing mechanism 83 is constituted by the holder fixing member 84, a spring for holding the holder fixing member 84 in an open state, and the air cylinder 90 for operating the holder fixing member 84 and urging it against the lens holder 2. However, the present invention is not limited to this. The holder fixing member 84 may be urged against the lens holder 2 by a spring, and the lens holder 2 held by the holder fixing member 84 may be released by an appropriate driving unit, mechanism, or the like.

According to this embodiment, in seal adhesion of urging the lens holding surface 9 of the lens holder 2 against the elastic seal 3, thus adhering the elastic seal 3 to the lens holding surface 3, the lens holding surface 9 is urged with a large urging force. Therefore, the elastic seal 3 can be reliably separated from the mount 253, and can be reliably adhered to the lens holding surface 9. In lens adhesion of urging the elastic seal 3 adhered to the lens holding surface 9 of the lens holder 2 against the lens 1, thus adhering the lens 1 to the elastic seal 3, the elastic seal 3 is urged with an urging force smaller than that in seal adhesion. Therefore, the lens 1 can be adhered reliably without being damaged. Also, the structure of the urging force change unit 255 is simple.

Figure 21:
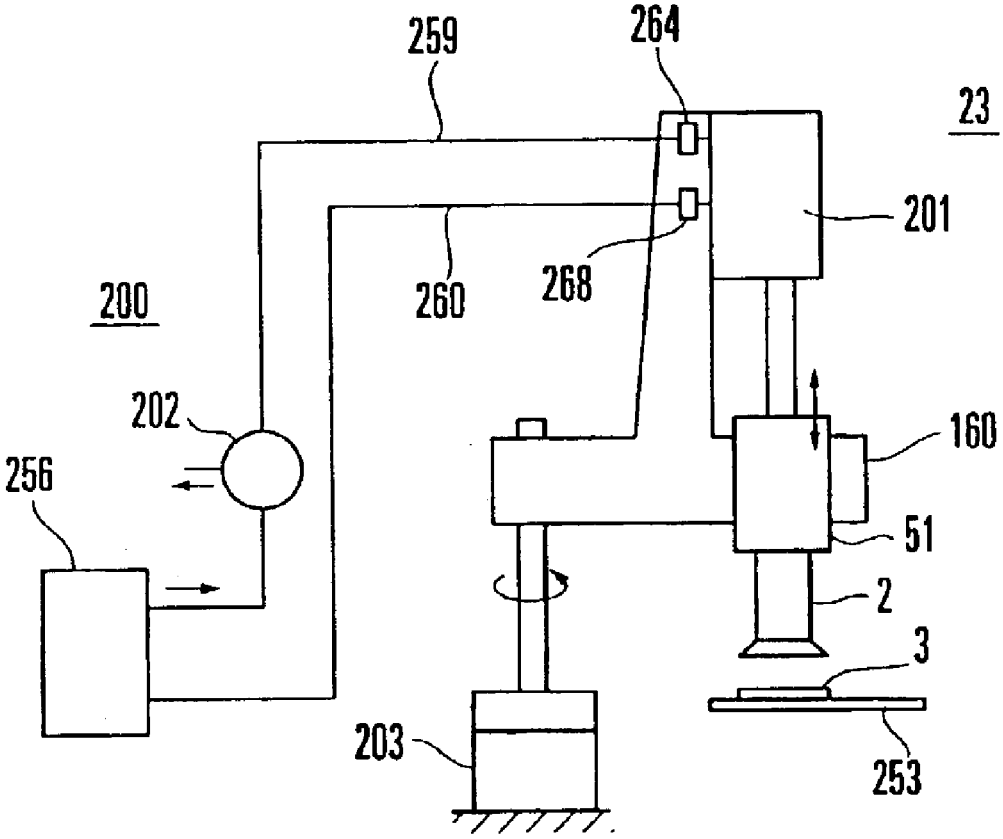
FIG. 21 is a view showing the schematic arrangement of another embodiment of the present invention.

FIG. 21 is a view showing the schematic arrangement of another embodiment of the present invention.

In this embodiment, a pivotal arm 160, a clamp unit 161 attached to the pivotal arm 160 to be vertically movable, a driving motor 203 with a reduction mechanism to pivot the pivotal arm 160, and an air cylinder 201 for vertically moving the clamp unit 161 make up a lens holding unit 23. The air cylinder 201, an air supply source 256, pipes 259 and 260, a selector valve 202 connected to the pipe 259 to which compressed air is supplied when the clamp unit 51 is to be moved downward, and the like make up an urging force change unit 200. The flow path of the selector valve 202 is switched by an electrical signal from a controller.

In this urging force change unit 200, in seal adhesion, high-pressure compressed air is supplied to the air cylinder 201, so a lens holder 2 is urged against an elastic seal 3 with a large urging force. In lens adhesion, the selector valve 202 is switched by the electrical signal from the controller to supply low-pressure compressed air to the air cylinder 201, so the elastic seal adhered to the lens holder is urged against the lens with an urging force smaller than that in seal adhesion. Therefore, the elastic seal 3 can be separated from a mount 253 reliably, in the same manner as in the above embodiment, and the lens can be adhered without being damaged.

In the above embodiment, the present invention is applied to an ABS 20 for a single-vision lens. However, the present invention is not limited to this, but can also be applied to an ABM for a progressive multifocal lens and a multifocal lens.

The urging force change unit 255 or 200 is not limited at all to those described in the above embodiments, but various changes and modifications can be made. It suffices as far as the urging force change unit can change the urging force for seal adhesion and lens adhesion.

When the holder according to the present invention is applied, the radius of curvature of the holder is selected to be larger than or equal to that of the convex lens surface of the lens, and this holder is mounted. Thus, the lens can be held in a peripheral abutting state. As a result, a high holding force can be obtained, and holding operation is not easily adversely affected by a mechanical vibration during processing, so lens misalignment and the like can be prevented.

According to the present invention, the rotation preventive portion is formed on the outer surface of each lens holder to engage with the engaging portion of the holder storing cassette. Therefore, the lens holders are not rotated, and can be aligned in one direction and stored in the cassette.

According to the present invention, members that are colored in different colors for the lens types, respectively, are provided. Compared to type indication by means of an identification symbol, number, or the like, a holder can be discriminated at a glance without examining it by holding it with a hand. The holder discrimination performance can thus be improved, and the holder can be automatically easily discriminated by using a sensor. Since the members are built in the lens holder to be seen from the outside, the outer shape or size of the holder itself does not change. Thus, the present invention can be applied to an existing holder as well. When storing the lens holder in a cassette, a mistake of erroneously storing a different type of holder can be prevented. When setting the cassette to an automatic centering unit, a mistake of setting it at an incorrect position can be prevented. Since the member may be pressed into the holder by a machine or manually, it can be built into the holder easily.

According to the present invention, a holder holding unit that automatically performs a series of steps of holding the lens holder, conveying the lens holder, adhering the elastic seal to the lens holder, and holding the lens by the elastic seal is provided. The lens will not be soiled or damaged. The burden to the operator is reduced considerably, labor saving can be achieved, and the operating efficiency and productivity can be improved.

According to the present invention, the elastic seal adhered to the lens holding surface of the lens holder is urged against the lens with an urging force smaller than that with which the lens holding surface of the lens holder is urged against the elastic seal. Therefore, adhesion of the elastic seal to the lens holder and adhesion of the lens to the elastic seal can be performed well and reliably. A damage to the lens, erroneous adhesion, and the like can accordingly be prevented. When adhesion is performed by the operator, the urging force may vary and defective adhesion may occur often. However, since adhesion is performed by automatically changing and setting the urging force, the urging force does not vary, and defective adhesion can be prevented.

What is claimed is:

1. A lens layout block device comprising means for adhering an elastic seal to a lens holder, means for causing said lens holder, to which the elastic seal is adhered, to hold a lens, a pivotal arm, an arm driving unit for pivoting said pivotal arm, a clamp means attached to said pivotal arm to be vertically movable to hold the lens holder, and a clamp driving unit for vertically moving said clamp means, wherein said pivotal arm is pivoted to sequentially adhere the elastic seal to the lens holder and hold the lens by the lens holder.

2. A lens layout block device comprising a holder holding means for holding a lens holder at a holder mounting position, conveying the lens holder to a seal adhering position, causing an elastic seal to be adhered to the lens holder at the seal adhering position and conveying the lens holder to a lens holding position, and causing a lens to be held by the elastic seal at the lens holding position, said holder holding means comprising a pivotal arm, an arm driving means for pivoting said pivotal arm within a horizontal plane, a clamp means for holding the lens holder attached to said pivotal arm to be vertically movable, and a clamp driving means for vertically moving said clamp unit.

3. A lens layout block device according to claim 2, wherein said clamp means comprises a cylindrical main body to fit on the lens holder, and a holder fixing mechanism for fixing the lens holder to the main body.

4. A lens layout block device according to claim 3, wherein said holder fixing mechanism comprises a pivotal holder fixing member, a spring for biasing said holder fixing member in a direction to separate it from the lens holder, and a lens holder driving means for urging the lens holder into a holding position.

5. A lens layout block device according to claim 2, further comprising an arm fixing means for fixing said pivotal arm to a pivot position when said clamp means moves to said lens holding means.

6. A lens holder structure formed of a cylindrical member and having a lens holding surface formed of a concave spherical surface at a distal end thereof to hold a plurality of types of lenses with convex lens surfaces of different curvatures by an elastic seal adhered to the lens holding surface, characterized in that the plurality of types of lenses are classified into a plurality of types of lens groups in which lenses with convex lens surfaces of similar curvatures each form one group, and the lens holder structure comprises a plurality of types of lens holders corresponding to the lens groups, each of the respective types of the lens holders serving to hold a lens belonging to a corresponding lens group with an edge of a lens holding surface thereof.

7. A lens holder structure according to claim 6, further comprising a rotation preventive portion engageable with an engaging portion of a holder storing cassette on an outer surface of the lens holder.

8. A lens holder structure according to claim 6, characterized by having members built in the lens holder and colored in different colors for respective lens types.

9. A lees holder structure formed of a cylindrical member and having a lens holding surface formed of a concave spherical surface at a distal end thereof to bold a plurality of types of lenses with convex lens surfaces of different curvatures by an elastic seal adhered to the lens holding surface, characterized in that the plurality of types of lenses are classified into a plurality of lens groups in which lenses with convex lens surfaces of similar curvatures each form one group, and the lens holder structure comprises a plurality of types of lens holders corresponding to the lens groups, each of respective types of the lens holders having a lens holding surface with a radius of curvature equal to or smaller than a minimum radius of curvature of a convex lens surface of a lens belonging to a corresponding lens group.

10. A lens holder structure according to claim 9, characterized by further comprising a rotation preventive portion engageable with an engaging portion of a holder storing cassette on an outer surface of the lens holder.

11. A lens holder structure according to claim 9, characterized by having members built in the lens holder and colored in different colors for respective lens types.

12. A lens layout block device for urging, at a seal adhering position, a lens holding surface of a lens holder against an elastic seal, thus adhering the elastic seal to the lens holding surface, and urging, at a blocking position, the elastic seal, adhered to the lens holding surface of the holder, against a lens, thus adhering the lens to the elastic seal, characterized by having a unit for urging the elastic seal, adhered to the lens holding surface to the lens holder, against the lens with an urging force smaller than that with which the lens holding surface of the lens holder is urged against the elastic seal.

13. A lens layout block device according to claim 12, further having a cylinder for vertically moving the lens holder, and fluid pressure switching means for switching fluid pressure supplied to said cylinder during seal mounting and lens adhesion.

* * * * *